US006689547B2

(12) United States Patent
Hunt et al.

(10) Patent No.: US 6,689,547 B2
(45) Date of Patent: Feb. 10, 2004

(54) THERMALLY DEVELOPABLE IMAGING MATERIALS WITH IMPROVED IMAGE UNIFORMITY

(75) Inventors: Bryan V. Hunt, Fridley, MN (US); Steven H. Kong, Woodbury, MN (US); William D. Ramsden, Afton, MN (US); Gary E. Labelle, Stillwater, MN (US)

(73) Assignee: Eastman Kodak Company, Rochester, NY (US)

( * ) Notice: Subject to any disclaimer, the term of this patent is extended or adjusted under 35 U.S.C. 154(b) by 30 days.

(21) Appl. No.: 10/011,892

(22) Filed: Dec. 5, 2001

(65) Prior Publication Data

US 2003/0162134 A1 Aug. 28, 2003

(51) Int. Cl.[7] ..... G03C 1/498; G03C 1/815; G03C 1/76

(52) U.S. Cl. ..... 430/350; 430/510; 430/517; 430/523; 430/581; 430/584; 430/607; 430/619; 430/620; 430/944; 430/961

(58) Field of Search ..... 430/350, 619, 430/523, 620, 944, 961, 607, 517, 510, 584, 581

(56) References Cited

U.S. PATENT DOCUMENTS

| | | | |
|---|---|---|---|
| 3,573,916 | A | 4/1971 | Yost et al. |
| 4,051,278 | A | 9/1977 | Democh |
| 5,258,282 | A | 11/1993 | Kagami et al. |
| 5,380,635 | A | 1/1995 | Gomez et al. |
| 5,380,644 | A | 1/1995 | Yonkoski et al. |
| 5,441,866 | A | 8/1995 | Miller et al. |
| 5,468,603 | A | 11/1995 | Kub |
| 5,541,054 | A | 7/1996 | Miller et al. |
| 5,621,983 | A | 4/1997 | Lundemann et al. |
| 5,763,153 | A | 6/1998 | Tsuzuki et al. |
| 5,881,476 | A | 3/1999 | Strobush et al. |
| 5,922,529 | A | 7/1999 | Tsuzuki et al. |
| 5,985,537 | A | 11/1999 | Philip, Jr. et al. |
| 5,998,126 | A | 12/1999 | Toya et al. |
| 6,114,106 | A | 9/2000 | Fujiwara et al. |
| 6,117,624 | A | 9/2000 | Shor et al. |
| 6,153,372 | A | 11/2000 | Arai et al. |

FOREIGN PATENT DOCUMENTS

| | | |
|---|---|---|
| EP | 0 792 476 B1 | 5/2000 |
| JP | 10-104780 | 4/1998 |

*Primary Examiner*—Thorl Chea
(74) *Attorney, Agent, or Firm*—J. Lanny Tucker; Louis M. Leichter

(57) ABSTRACT

A photothermographic material that comprises a support having thereon one or more thermally-developable imaging layers comprising a binder and in reactive association, a photosensitive silver halide, a non-photosensitive source of reducible silver ions, and a reducing composition for the non-photosensitive source reducible silver ions. The thermally-developable layers further comprises one or more radiation absorbing compounds that provide a total absorbance of greater than 0.6 and up to and including 3 in the thermally-developable imaging layer(s). These photothermographic materials exhibit reduced mottle without significant loss in sensitivity.

26 Claims, 1 Drawing Sheet

THERMALLY DEVELOPABLE IMAGING MATERIALS WITH IMPROVED IMAGE UNIFORMITY

FIELD OF THE INVENTION

This invention relates to thermally developable imaging materials such as photothermographic materials. More particularly, it relates to photothermographic imaging materials that exhibit decreased mottle and improved image uniformity upon exposure and development. The invention also relates to methods of imaging using these materials. This invention is directed to the photothermographic imaging industry.

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet or infrared radiation) and developed by the use of thermal energy. These materials, also known as "dry silver" materials, generally comprise a support having coated thereon: (a) a photosensitive catalyst (such as silver halide) that upon such exposure provides a latent image in exposed grains that is capable of acting as a catalyst for the subsequent formation of a silver image in a development step, (b) a non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms, $(Ag^0)_n$, also known as silver specks, clusters, nuclei, or latent image, are generated by irradiation or light exposure of the photosensitive silver halide, those silver atoms are able to catalyze the reduction of the reducible silver ions within a catalytic sphere of influence around the silver atoms [D. H. Klosterboer, in *Imaging Processes and Materials*, (*Neblette's Eighth Edition*), J. Sturge, V. Walworth, and A. Shepp, Eds., Van Nostrand-Reinhold, New York, 1989, Chapter 9, pp. 279–291]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, cadmium sulfide, and zinc oxide, have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi*, 1994, 11, 992–997, and FR 2,254,047 (Robillard)].

The photosensitive silver halide may be made "in situ", for example, by mixing an organic or inorganic halide-containing source with a source of reducible silver ions to achieve partial metathesis and thus causing the in situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Usanov et al., *J. Imag. Sci. Tech.* 1996, 40, 104]. Alternatively, a portion of the reducible silver ions can be completely converted to silver halide, and that portion can be added back to the source of reducible silver ions (see Usanov et al., International Conference on Imaging Science, Sep. 7–11, 1998).

The silver halide may also be "preformed" and prepared by an "ex situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to, and be present during, the formation of the source of reducible silver ions. Co-precipitation of the silver halide and the source of reducible silver ions provides a more intimate mixture of the two materials [see for example, U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids". Silver salts of other organic acids or other organic compounds, such as silver imidazoles, silver tetrazoles, silver benzotriazoles, silver benzotetrazoles, silver benzothiazoles and silver acetylides have also been proposed. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer", may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography", the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is, in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al., Eds., The Focal Press, London and New York, 1978, pp. 74–75, in Zou et al., *J. Imaging Sci. Technol.* 1996, 40, pp. 94–103, and in M. R. V Sahyun, *J. Imaging Sci. Technol.*, 1998, 42, 23.

Problem to be Solved

Thermally developable materials have gained widespread use in several industries, particularly in radiography. Such materials are usually constructed by coating layer formulations from solution and removing as much of the solvent as possible by drying. Problems that arise with this manufacturing process include the formation of coating defects that can be attributed to the various coating and drying conditions and procedures.

One such coating defect, referred to as "mottle", arises from an unevenness in the distribution of solid materials formed within a coating as solvent is removed during drying [see, for example, *Modern Coating and Drying Technology*, Eds. E. D. Cohen and E. B. Gutoff, Eds., VCH Publishers, New York, 1992, p. 288]. It is believed to be caused by a non-uniform airflow blowing the coating around in the early stages of the drying process when the coating is still quite fluid. This can occur in the coating before it enters the dryer, as it enters the dryer, or in the dryer and can be more severe with coating solvents of increased volatility [see, for example, *Coating and Drying Defects: Troubleshooting Operating Problems*, E. B. Gutoff and E. D. Cohen, John Wiley and Sons, New York, 1995, p. 203].

In a coated material, mottle appears as an irregular pattern of non-uniform density that appears blotchy when viewed. The pattern may take on an orientation or direction. The scale can be quite small or quite large and may be on the order of centimeters. The blotches may appear to have different colors or shades of colors and can be gross or subtle.

Mottle may not be readily apparent in undeveloped photothermographic materials but upon thermal development it becomes more evident. For example, in black-and-white photothermographic materials upon development the resulting non-uniform image density may appear as shades of gray.

Various techniques have been used for reducing mottle in coated materials. For example, to reduce the severity of non-uniform airflow on the undried coating, dryer airflow and web speed can be reduced. However, this can lower the coating line speed, reduce manufacturing efficiency, and increase manufacturing costs.

Careful control of oven design, as well as coating and/or drying conditions, have also been used to control mottle. Some of these techniques are described in U.S. Pat. No. 4,051,278 (Democh), U.S. Pat. No. 5,881,476 (Strobush et al.), and U.S. Pat. No. 5,621,983 (Ludemann et al.).

Surfactants have also been incorporated into coating formulations used to reduce mottle, including for example fluorinated surfactants as described for example in U.S. Pat. No. 5,380,644 (Yonkoski et al.) and U.S. Pat. No. 5,532,121 (Yonkoski et al.). However, the use of surfactants may lead to other problems as they may adversely affect the sensitometric properties of the imaging materials as well as their ability to be fed and transported within the imaging apparatus.

The techniques described above may limit the manufacturability of the materials, produce other undesirable properties in the materials, or may not sufficiently reduce mottle for all imaging material requirements.

Furthermore, it is known in the imaging arts, including photothermographic art, to incorporate acutance dyes into imaging layers to improve sharpness [see for example, U.S. Pat. No. 5,380,635 (Gomez et al.) and U.S. Pat. No. 5,922,529 (Tsuzuki et al.)]. It is also known to add such materials to reduce interference fringes during laser exposure [see for example, U.S. Pat. No. 5,998,126 (Toya et al.)], and to reduce "woodgrain" [see for example, EP 0 792 476 B1 (Geisler et al.)]. The acutance dyes are incorporated into the photothermographic materials due in an amount necessary to provide an absorbance in the range of 0.05 to 0.6. Higher absorbance is not believed to provide additional benefits in image sharpness or reduction of interference fringes.

It is desirable to reduce the formation of mottle during manufacture of photothermographic materials without the use of surfactants or modification of coating and drying procedures. There is also a need to accomplish this without an unacceptable loss in sensitivity.

SUMMARY OF THE INVENTION

This invention provides a photothermographic material that comprises a support having thereon one or more thermally-developable imaging layers comprising a binder and in reactive association, a photosensitive silver halide, a non-photosensitive source of reducible silver ions, and a reducing composition for the non-photosensitive source of reducible silver ions, wherein the one or more thermally-developable imaging layers further comprise one or more radiation absorbing substances that provide a total absorbance in the one or more thermally-developable imaging layers of greater than 0.6 and up to and including 3 at an exposure wavelength, the one or more radiation absorbing substances being chosen such that when they are incorporated into the one or more thermally-developable layers to provide a total absorbance of from about 0.6 to about 1.2, the log of the exposure (in ergs/cm$^2$) required to produce an image density of $1+D_{min}$, increases by less than 0.4 per absorbance unit.

The photothermographic materials of this invention exhibit reduced mottle after imaging and thermal development without an unacceptable loss in sensitivity. The appearance of mottle is reduced without having to use surfactants in the coated layers and without adjusting coating and drying conditions in manufacturing operations, thereby providing an improved imaging material with good manufacturability.

These advantages have been achieved by incorporating certain radiation absorbing compounds (generally dyes) in the one or more thermally developable imaging layers of the photothermographic materials in a quantity sufficient to provide a total optical density (or absorbance) in those layers of greater than 0.6 and up to and including 3. These absorbing compounds may not reduce the susceptibility of the wet coatings to being blown about by non-uniform airflow, but they reduce the appearance of mottle in the imaged and developed photothermographic material.

To achieve optimal sensitivity, not just any dyes that provide the absorbance greater than 0.6 can be used in the practice of this invention. The most useful radiation absorbing compounds must provide the desired high absorbance without requiring too great of an increase in imaging exposure to obtain desired image density. This is achieved by requiring the radiation absorbing compounds meet the additional parameter that the log of the exposure (in ergs/cm) required to produce a density of $1+D_{min}$ should increase by less than 0.4 per absorbance unit when the radiation absorbing compound is present to provide an absorbance between 0.6 and 1.2.

In addition, the dyes must not interfere with the manufacturing process and permit high speed coating and drying of the photothermographic material.

When comparing radiation absorbing compounds, sensitivity loss should be determined at an absorbance between 0.6 and 1.2. This feature does not limit the use of the invention to this absorbance range, however, but enables a more even comparison among compounds to determine which ones are preferable or optimal for use in a given photothermographic material. The best radiation absorbing compounds can then be used to provide an absorbance of 2.0 or more if contrast is properly adjusted to maintain desired sensitometric properties.

In another embodiment, this invention provides a photothermographic material having one or more thermally developable imaging layers on both sides of the support.

Further, a method of this invention for forming a visible image comprises:

A) imagewise exposing the black and white photothermographic material described above to electromagnetic radiation at a wavelength greater than 700 nm to form a latent image, and B) simultaneously or sequentially, heating the exposed photothermographic material to develop the latent image into a visible image.

When the photothermographic materials of this invention are heat-developed, as described below, in a substantially water-free condition after, or simultaneously with, imagewise exposure, a silver image (preferably a black-and-white silver image) is obtained. The photothermographic material may be exposed in step A using an laser, a laser diode, a light-emitting screen, CRT tube, a light-emitting diode, a light bar, or other radiation source readily apparent to one skilled in the art.

In some embodiments of the imaging method of this invention, the photothermographic material has a transparent support and the imaging method further includes:

C) positioning the exposed and heat-developed photothermographic material between a source of imaging radiation and an imageable material that is sensitive to the imaging radiation, and D) thereafter exposing the imageable material to the imaging radiation through the visible image in the exposed and heat-developed photothermographic material to provide an image in the imageable material.

Preferred embodiments of this invention include black-and-white photothermographic materials each comprising a support having on one side thereof:

a) a thermally-developable imaging layer comprising a hydrophobic binder and in reactive association, a photosensitive silver bromide or silver bromoiodide, or mixtures thereof, one or more non-photosensitive silver carboxylates, at least one of which is silver behenate, and a merocyanine or cyanine spectral sensitizing dye, b) a protective layer that is farther from the support than the imaging layer, the photothermographic material also comprising an antihalation layer on the backside of the support, the antihalation layer comprising a binder and at least one antihalation dye, wherein the thermally-developable imaging layer further comprises one or more radiation absorbing substances that provide a total absorbance in the one or more thermally-developable imaging layers greater than 0.6 and up to and including 3 at an exposure wavelength, the one or more radiation absorbing substances chosen such that when they are incorporated into the thermally-developable layer to provide a total absorbance of from about 0.6 to about 1.2, the log of the exposure (in ergs/cm$^2$) required to produce an image density of $1+D_{min}$ increases by less than 0.4 per absorbance unit, and the one or more radiation absorbing substances being cyanine, hemicyanine, merocyanine, squaraine, or oxanol dyes, or mixtures thereof.

DETAILED DESCRIPTION OF THE INVENTION

Figure 1:
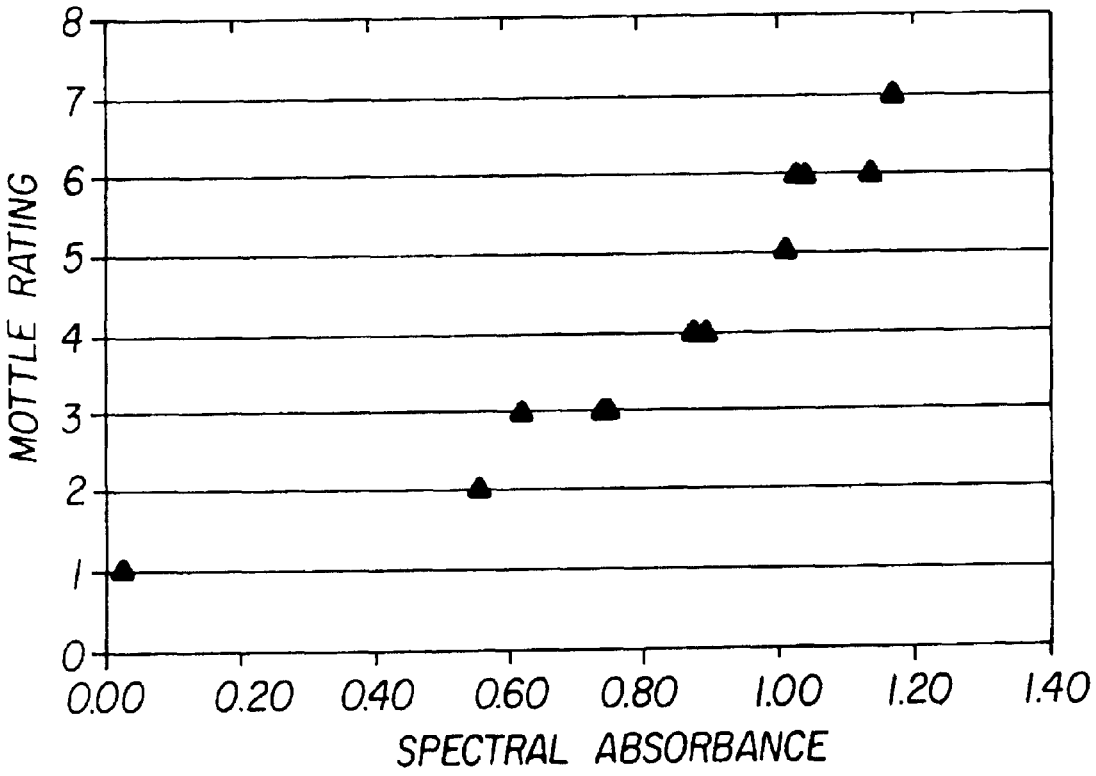
FIG. 1 is a graphical representation of "mottle rating" vs. spectral absorbance for the photothermographic materials that were prepared and evaluated in Examples 1 and 2 below.

The photothermographic materials of this invention can be used, for example, in conventional black-and-white or color photothermography, and in electronically generated black-and-white or color hardcopy recording. They can be used in microfilm applications, in radiographic imaging (for example, digital medical imaging), and industrial radiography. Furthermore, the absorbance of these photothermographic materials between 350 and 450 nm is desirably low (less than 0.5), to permit their use in the graphic arts area (for example, image-setting and phototypesetting), in the manufacture of printing plates, in contact printing, in duplicating ("duping"), and in proofing. The photothermographic materials of this invention are particularly useful for medical radiography to provide black-and-white images.

In one embodiment, the photothermographic materials of this invention are sensitive to radiation at a wavelength of at least 700 nm, and preferably at a wavelength of from about 750 to about 1400 nm.

In the photothermographic materials of this invention, the components needed for imaging can be in one or more layers. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity (that is, in reactive association with each other) and preferably are in the same emulsion layer. "Catalytic proximity" or "reactive association" means that they should be in the same layer or in adjacent layers.

Various layers are usually disposed on the "backside" (non-emulsion side) of the materials, including additional photothermographic layers, antihalation layer(s), protective layers, antistatic layers, conducting layers, and transport enabling layers.

Various layers are also usually disposed on the "frontside" or emulsion side of the support, including protective topcoat layers, barrier layers, primer layers, interlayers, opacifying layers, antistatic layers, antihalation layers, acutance layers, auxiliary layers, and others readily apparent to one skilled in the art.

In preferred embodiments of the present invention the photothermographic materials further comprise a surface protective layer on the same side of the support as the one or more thermally-developable layers, an antihalation layer on the opposite side of the support, or both a surface protective layer and an antihalation layer on their respective sides of the support.

Definitions

As used herein:

In the descriptions of the photothermographic materials of the present invention, "a" or "an" component refers to "at least one" of that component. For example, the radiation absorbing substances described herein can be used individually or in mixtures.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, 1977, p. 374.

"Photothermographic material(s)" means a construction comprising at least one photothermographic emulsion layer or a photothermographic set of layers (wherein the silver halide and the source of reducible silver ions are in one layer and the other essential components or desirable additives are distributed, as desired, in an adjacent coating layer) and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Emulsion layer", "imaging layer", or "photothermographic emulsion layer", means a layer of a photothermographic material that contains the photosensitive silver halide and/or non-photosensitive source of reducible silver ions. It can also mean a layer of the photothermographic material that contains, in addition to the photosensitive silver halide and/or non-photosensitive source of reducible ions, additional essential components and/or desirable additives. These layers are usually on what is known as the "frontside" of the support.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

An auxochrome is a group of atoms that when conjugated to a chromophore intensifies and/or shifts the color of that chromophore.

"Non-photosensitive" means not intentionally light sensitive.

"Transparent" means capable of transmitting visible light or imaging radiation without appreciable scattering or absorption.

The sensitometric terms "photospeed" or "photographic speed" (also known as "sensitivity"), "contrast", $D_{min}$, and $D_{max}$ have conventional definitions known in the imaging arts.

The sensitometric term optical density is another term for "absorbance."

In the compounds described herein, no particular double bond geometry (for example, cis or trans) is intended by the structures drawn. Similarly, the alternating single and double bonds and localized charges are drawn as a formalism. In reality, both electron and charge delocalization exists throughout the conjugated chain.

As is well understood in this art, for the compounds described herein, substitution is not only tolerated, but is often advisable and various substituents are anticipated on the compounds used in the present invention. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group", such as "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example, $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver bromoiodide, silver chlorobromoiodide, silver chlorobromide and others readily apparent to one skilled in the art. Mixtures of silver halides can also be used in any suitable proportion. Silver bromide and silver bromoiodide are more preferred, with the latter silver halide having up to 10 mol % silver iodide. Typical techniques for preparing and precipitating silver halide grains are described in *Research Disclosure*, 1978, Item 17643.

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, or platelet morphologies, and may have epitaxial growth of crystals thereon. If desired, a mixture of these crystals may be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one halide ratio, and a discrete shell of another halide ratio. Core-shell silver halide grains useful in photothermographic materials and methods of preparing these materials are described for example, in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions. It is more preferable to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example, U.S. Pat. No. 3,839,049 (Simons)]. Materials of this type are often referred to as "preformed soaps".

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 $\mu$m.

The average size of the photosensitive doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis", ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.) and U.S. Pat. No. 2,489,341 (Waller et al.)].

It is also effective to use an in situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

Additional methods of preparing these silver halide and organic silver salts and manners of blending them are described in *Research Disclosure*, June 1978, item 17029, U.S. Pat. No. 3,700,458 (Lindholm) and U.S. Pat. No. 4,076,539 (Ikenoue et al.), and JP Applications 13224/74, 42529/76, and 17216/75.

In some instances, it may be helpful to prepare the photosensitive silver halide grains in the presence of a hydroxytetrazaindene (such as 4-hydroxy-6-methyl-1,3,3,3a,7-tetrazaindene) or an N-heterocyclic compound comprising at least one mercapto group (such as 1-phenyl-5-mercaptotetrazole) to provide increased photospeed. Details of this procedure are provided in commonly assigned U.S. Pat. No. 6,413,710 (Shor et al.) incorporated herein by reference.

The one or more light-sensitive silver halides used in the photothermographic materials of the present invention are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical and Spectral Sensitizers

The photosensitive silver halides used in the invention may be employed without modification. However, one or more conventional chemical sensitizers may be used in the preparation of the photosensitive silver halides to increase photospeed. Such compounds may contain sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, 1977, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP-A-0 915,371 (Lok et al.).

In one embodiment, chemical sensitization is achieved by oxidative decomposition of a spectral sensitizing dye in the presence of a photothermographic emulsion. Such sensitization is described in U.S. Pat. No. 5,891,615 (Winslow et al.), incorporated herein by reference.

In another embodiment, certain substituted and unsubstituted thiourea compounds can be used as chemical sensitizers. Particularly useful tetra-substituted thioureas are described in commonly assigned U.S. Pat. No. 6,368,779 (Lynch et al.), that is incorporated herein by reference.

Still other useful chemical sensitizers include certain tellurium-containing compounds that are described in commonly assigned U.S. Ser. No. 09/975,909 (filed Oct. 11, 2001 by Lynch, Opatz, Shor, Simpson, Willett, and Gysling), that is incorporated herein by reference.

Combinations of gold(III)-containing compounds and either sulfur- or tellurium-containing compounds are useful as chemical sensitizers as described in commonly assigned U.S. Pat. No. 6,423,481 (Simpson et al.), that is also incorporated herein by reference.

The chemical sensitizers can be used in making the silver halide emulsions in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 2 $\mu$m. The upper limit can vary depending upon the compound(s) used, the level of silver halide and the average grain size, and would be readily determinable by one of ordinary skill in the art.

In general, it may also be desirable to add spectral sensitizing dyes to enhance silver halide sensitivity to ultraviolet, visible, and infrared light. Thus, the photosensitive silver halides may be spectrally sensitized with various dyes that are known to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. The cyanine dyes, merocyanine dyes and complex merocyanine dyes are particularly useful. The cyanine dyes preferably include benzothiazole, benzoxazole, and benzoselenazole dyes that include one or more alkylthio, arylthio, or thioether groups. Suitable sensitizing dyes such as those described in U.S. Pat. No. 3,719,495 (Lea), U.S. Pat. No. 5,393,654 (Burrows et al.), U.S. Pat. No. 5,441,866 (Miller et al.) and U.S. Pat. No. 5,541,054 (Miller et al.), U.S. Pat. No. 5,281,515 (Delprato et al.), and U.S. Pat. No. 5,314,795 (Helland et al.) can be used in the practice of the invention. All of the patents above are incorporated herein by reference.

An appropriate amount of spectral sensitizing dye added is generally about $10^{-10}$ to $10^{-1}$ mole, and preferably, about $10^{-7}$ to $10^{-2}$ mole per mole of silver halide.

Non-photosensitive Source of Reducible Silver Ions

The non-photosensitive source of reducible silver ions used in photothermographic materials of this invention can be any compound that contains reducible silver (1+) ions. Preferably, it is a silver salt that is comparatively stable to light and forms a silver image when heated to 50° C. or higher in the presence of an exposed photocatalyst (such as silver halide) and a reducing composition.

Silver salts of organic acids, particularly silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, at least silver behenate is used alone or in mixtures with other silver salts.

Preferred examples of the silver salts of aromatic carboxylic acid and other carboxylic acid group-containing compounds include, but are not limited to, silver benzoate, and silver substituted-benzoates, (such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver tannate, silver phthalate, silver terephthalate, silver salicylate, silver phenylacetate, and silver pyromellitate).

Silver salts of aliphatic carboxylic acids containing a thioether group as described in U.S. Pat. No. 3,330,663 (Weyde et al.) are also useful. Soluble silver carboxylates comprising hydrocarbon chains incorporating ether or thioether linkages, or sterically hindered substitution in the α- (on a hydrocarbon group) or ortho- (on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of sulfonates are also useful in the practice of this invention. Such materials are described, for example, in U.S. Pat. No. 4,504,575 (Lee). Silver salts of sulfosuccinates are also useful as described for example, in EP-A-0 227 141 (Leenders et al.).

Silver salts of compounds containing mercapto or thione groups and derivatives thereof can also be used. Preferred examples of these compounds include, but are not limited to, a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido)benzothiazole, silver salts of thioglycolic acids (such as a silver salt of a S-alkylthioglycolic acid, wherein the alkyl group has from 12 to 22 carbon atoms), silver salts of dithiocarboxylic acids (such as a silver salt of dithioacetic acid), a silver salt of thioamide, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptotriazole derivative, such as a silver salt of 3-amino-5-benzylthio-1,2,4-triazole), and a silver salt of thione compounds [such as a silver salt of 3-(2-carboxyethyl)-4-methyl-4-thiazoline-2-thione as described in U.S. Pat. No. 3,785,830 (Sullivan et al.).].

Furthermore, a silver salt of a compound containing an imino group can be used. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Moreover, silver salts of acetylenes can also be used as described, for example, in U.S. Pat. No. 4,761,361 (Ozaki et al.) and U.S. Pat. No. 4,775,613 (Hirai et al.).

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of an ammonium or an alkali metal salt of a commercial fatty carboxylic acid, or by addition of the free fatty acid to the silver soap. For transparent films a silver carboxylate full soap, containing not more than about 15% of free fatty carboxylic acid and analyzing for about 22% silver, can be used. For opaque photothermographic materials, different amounts can be used.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

Non-photosensitive sources of reducible silver ions can also be provided as core-shell silver salts such as those described in commonly assigned U.S. Pat. No. 6,355,408 (Whitcomb et al.), that is incorporated herein by reference. These silver salts include a core comprised of one or more silver salts and a shell having one or more different silver salts.

Still another useful source of non-photosensitive reducible silver ions in the practice of this invention are the silver dimer compounds that comprise two different silver salts as described in U.S. Pat. No. 6,472,131 , that is incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

As one skilled in the art would understand, the non-photosensitive source of reducible silver ions can include various mixtures of the various silver salt compounds described herein, in any desirable proportions.

The photocatalyst and the non-photosensitive source of reducible silver ions must be in catalytic proximity (that is, reactive association). It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 mol/m$^2$ of dried photothermographic material, and preferably from about 0.01 to about 0.05 mol/m$^2$ of that material.

The total amount of silver (from all silver sources) in the photothermographic materials is generally at least 0.002 mol/m and preferably from about 0.01 to about 0.05 mol/m$^2$ of the material.

Reducing Agents

The reducing agent (or reducing agent composition comprising two or more components) for the source of reducible silver ions can be any material, preferably an organic material, that can reduce silver(I) ion to metallic silver. Conventional photographic developers such as methyl gallate, hydroquinone, substituted hydroquinones, hindered phenols, amidoximes, azines, catechol, pyrogallol, ascorbic acid (and derivatives thereof), leuco dyes and other materials readily apparent to one skilled in the art can be used in this manner as described for example, in U.S. Pat. No. 6,020,117 (Bauer et al.).

In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes described below.

Hindered phenol reducing agents are preferred (alone or in combination with one or more high contrast co-developing agents and co-developer contrast-enhancing agents). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthyl) methanes, bis(hydroxyphenyl)methanes, hindered phenols, and hindered naphthols, each of which may be variously substituted.

Representative binaphthols include, but are not limited to, 1,1'-bi-2-naphthol, 1,1'-bi-4-methyl-2-naphthol, and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited to, 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichlorobiphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1'-bis(2-hydroxy-3,5-dimethylphenyl)-3,5,5-trimethylhexane (NONOX™ or PERMANAX™ WSO), 1,1'-bi s(3,5-di-t-butyl-4-hydroxyphenyl)methane, 2,2'-bis(4-hydroxy-3-methylphenyl)propane, 4,4'-ethylidene-bis(2-t-butyl-6-methylphenol), 2,2'-isobutylidene-bis(4,6-dimethylphenol) (LOWINOX™ 221B46), and 2,2'-bis(3,5-dimethyl-4-hydroxyphenyl) propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems include amidoximes such as phenylamidoxime, 2-thienylamidoxime and p-phenoxyphenylamidoxime, azines (for example, 4-hydroxy-3,5-dimethoxybenzaldehydrazine), a combination of aliphatic carboxylic acid aryl hydrazides and ascorbic acid, such as 2,2'-bis(hydroxymethyl)-propionyl-p-phenyl hydrazide in combination with ascorbic acid, a combination of polyhydroxybenzene and hydroxylamine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenylacetate and ethyl-α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfonamidophenol), 2-phenylindane-1,3-dione and similar compounds, chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), 3-pyrazolidones, and certain indane-1,3-diones.

An additional class of reducing agents that can be used as developers are substituted hydrazines including the sulfonyl hydrazides described in U.S. Pat. No. 5,464,738 (Lynch et al.). Still other useful reducing agents are described for example, in U.S. Pat. No. 3,074,809 (Owen), U.S. Pat. No. 3,094,417 (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.). All of these patents are incorporated herein by reference.

Useful co-developer reducing agents can also be used as described for example, in U.S. Ser. No. 09/239,182 (filed Jan. 28, 1999 by Lynch and Skoog), incorporated herein by reference. Examples of these compounds include, but are not limited to, 2,5-dioxo-cyclopentane carboxaldehydes, 5-(hydroxymethylene)-2,2-dimethyl-1,3-dioxane4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds that are described in U.S. Pat. No. 5,635,339 (Murray) and U.S. Pat. No. 5,545,515 (Murray et al.), both incorporated herein by reference. Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene)cyanoacetates and their metal salts.

Various contrast enhancers can be used in some photothermographic materials with specific co-developers. Examples of useful contrast enhancers include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the above patents are incorporated herein by reference.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

For color imaging materials (for example, monochrome, dichrome, or full color images), one or more reducing agents can be used that can be oxidized directly or indirectly to form or release one or more dyes.

The dye-forming or releasing compound may be any colored, colorless, or lightly colored compound that can be oxidized to a colored form, or to release a preformed dye when heated, preferably to a temperature of from about 80° C. to about 250° C. for a duration of at least 1 second. When used with a dye- or image-receiving layer, the dye can diffuse through the imaging layers and interlayers into the image-receiving layer of the photothermographic material.

Leuco dyes or "blocked" leuco dyes are one class of dye-forming compounds (or "blocked" dye-forming compounds) that form and release a dye upon oxidation by silver ion to form a visible color image in the practice of the present invention. Leuco dyes are the reduced form of dyes that are generally colorless or very lightly colored in the visible region (optical density of less than 0.2). Thus, oxidation provides a color change that is from colorless to colored, an optical density increase of at least 0.2 units, or a substantial change in hue.

Representative classes of useful leuco dyes include, but are not limited to, chromogenic leuco dyes (such as indoaniline, indophenol, or azomethine dyes), imidazole leuco dyes such as 2-(3,5-di-t-butyl-4-hydroxyphenyl)-4,5-diphenylimidazole as described for example in U.S. Pat. No. 3,985,565 (Gabrielson et al.), dyes having an azine, diazine, oxazine, or thiazine nucleus such as those described for example in U.S. Pat. No. 4,563,415 (Brown et al.), U.S. Pat. No. 4,622,395 (Bellus et al.), U.S. Pat. No. 4,710,570 (Thien), and U.S. Pat. No. 4,782,010 (Mader et al.), and benzylidene leuco compounds as described for example in U.S. Pat. No. 4,923,792 (Grieve et al.), all incorporated herein by reference. Further details about the chromogenic leuco dyes noted above can be obtained from U.S. Pat. No. 5,491,059 (noted above, Column 13) and references noted therein.

Another useful class of leuco dyes are what are known as "aldazine" and "ketazine" leuco dyes that are described for example in U.S. Pat. No. 4,587,211 (Ishida et al.) and U.S. Pat. No. 4,795,697 (Vogel et al.), both incorporated herein by reference.

Still another useful class of dye-releasing compounds are those that release diffusible dyes upon oxidation. These are known as preformed dye release (PDR) or redox dye release (RDR) compounds. In such compounds, the reducing agents release a mobile preformed dye upon oxidation. Examples of such compounds are described in U.S. Pat. No. 4,981,775 (Swain), incorporated herein by reference.

Further, other useful image-forming compounds are those in which the mobility of a dye moiety changes as a result of an oxidation-reduction reaction with silver halide, or a nonphotosensitive silver salt at high temperature, as described for example in JP Kokai 165,054/84.

Still further, the reducing agent can be a compound that releases a conventional photographic dye forming color coupler or developer upon oxidation as is known in the photographic art.

The dyes that are formed or released can be in the same or different imaging layers. A difference of at least 60 nm in reflective maximum absorbance is preferred. More preferably, this difference is from about 80 to about 100 nm. Further details about the various dye absorbances are provided in U.S. Pat. No. 5,491,059 (noted above, Col. 14).

The total amount of one or more dye- forming or releasing compound that can be incorporated into the photothermographic materials of this invention is generally from about 0.5 to about 25 weight % of the total weight of each imaging layer in which they are located. Preferably, the amount in each imaging layer is from about 1 to about 10 weight %, based on the total dry layer weight. The useful relative proportions of the leuco dyes would be readily known to a skilled worker in the art.

Radiation Absorbing Compounds

It is essential that the one or more thermally-developable imaging layers present in the photothermographic materials of this invention include one or more radiation absorbing compounds to provide a combined (or total) absorbance in the imaging layer(s) of greater than 0.6 (preferably 1 or more) at the exposing wavelength. The upper limit of absorbance is generally 3 (preferably 2). Another term for "absorbance" is optical density. The desired absorbance can also be provided by radiation absorbing compounds that are incorporated into non-imaging layers that are disposed over the thermally-developable imaging layers as long as the radiation absorbing compounds can diffuse into the thermally-developable imaging layers prior to or during coating operations.

Although numerous radiation absorbing compounds can be used to improve mottle many of these compounds do so along with an unacceptable loss in sensitivity. Particular dyes have been found which provide sufficient absorption to reduce mottle with only minimal sensitivity loss as defined below by the "imaging sensitivity test."

The essential "imaging sensitivity test" for the photothermographic materials of this invention is defined as follows:

When the radiation absorbing compounds are incorporated into the one or more thermally-developable layers to provide a total absorbance of from about 0.6 to about 1.2, the log of the exposure (in ergs/cm$^2$) required to produce an image density of $1+D_{min}$ increases by less than 0.4 per absorbance unit. Thus, the radiation absorbing compounds useful in the present invention provide high absorbance to reduce mottle, without an unacceptable decrease in photospeed.

Absorbance can be determined using the procedures described in U.S. Pat. No. 5,922,529 (Tsuzuki et al.), Col. 47, incorporated herein by reference.

In general, a skilled worker can determine with routine experimentation how much of a given radiation absorbing compound (or mixture of compounds) should be used to provide the desired absorbance. Usually, this amount is at least $10^{-6}$ mol/m$^2$, and preferably it is from about $10^{-5}$ to about $10^{-3}$ mol/m$^2$.

The desired level of absorbance can be provided by the addition of one or more radiation absorbing compounds from one or more classes of dye compounds.

One class of dyes useful as radiation absorbing compounds in this invention, many of whose members pass the essential sensitivity test described above cyanine dyes that can be represented by the following Structure I.

I

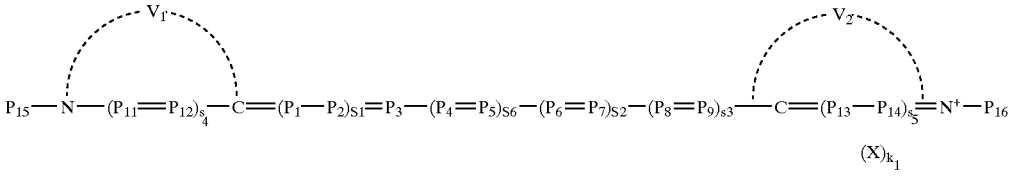

wherein $V_1$ and $V_2$ independently represent the non-metallic atoms necessary to form substituted or unsubstituted 5-, 6-, or 7-membered heterocyclic rings, $P_{15}$ and $P_{16}$ independently represent alkyl, aryl, alkaryl, or heterocycl groups, $P_1$, $P_2$, $P_3$, $P_4$, $P_5$, $P_6$, $P_7$, $P_8$, $P_9$, $P_{11}$, $P_{12}$, $P_{13}$, and $P_{14}$ independently represent substituted or unsubstituted methine groups that may optionally form a ring with one or more other methine groups or with an auxochrome, $s_1$, $s_2$, $s_3$, $s_4$, $s_5$ and $s_6$ are independently equal to 0 or 1, X is an electric charge neutralizing counterion, and $k_1$ is an integer inclusive of 0 necessary to neutralize an electric charge in the molecule.

$V_1$ and $V_2$ independently represent the non-metallic atoms necessary to form substituted or unsubstituted 5-, 6-, or 7-membered heterocyclic rings that may also include in addition to the hetero nitrogen atom, a second hetero atom such as a second nitrogen, oxygen, selenium, or sulfur atom. $V_1$ and $V_2$ also may be further substituted, for example, to form additional rings fused to the heterocyclic nucleus, and have additional substituents attached thereon.

In a preferred embodiment the substituted methine groups represented by $P_1$, $P_2$, $P_3$, $P_4$, $P_5$, $P_6$, $P_7$, $P_8$, $P_9$, $P_{11}$, $P_{12}$, $P_{13}$, and $P_{14}$ may be further substituted with substituted or unsubstituted alkyl groups of up to 20 carbon atoms, substituted or unsubstituted aryl groups of up to 20 carbon atoms, halogen atoms (F, Cl, Br, and I), substituted or unsubstituted alkoxy, aryloxy, alkylthio, or arylthio groups of up to 20 carbon atoms (such as methoxy, ethoxy, phenoxy, thiomethyl, thioethyl, or thiophenyl), substituted or unsubstituted alkoxyalkylene groups, substituted or unsubstituted alkylthioalkeylene groups (such as methoxyethylene and ethylthioethylene), primary, secondary, and tertiary amino groups of up to 20 carbon atoms, substituted or unsubstituted heterocyclic ring groups comprising up to 6 ring atoms, substituted or unsubstituted carbocyclic ring groups comprising up to 6 ring carbon atoms, and substituted or unsubstituted fused ring and bridging groups comprising up to 14 ring atoms.

In another preferred embodiment, the methine groups represented by $P_1$, $P_2$, $P_3$, $P_4$, $P_5$, $P_6$, $P_7$, $P_8$, and $P_9$, are independently substituted with alkyl or alkoxy groups of up to 6 carbon atoms, or are joined to form one or more substituted or unsubstituted 5-, 6-, or 7-membered rings, or two or more fused substituted or unsubstituted 5-, 6-, or 7-membered rings.

Preferably, $P_{15}$ and $P_{16}$ are independently substituted or unsubstituted alkyl groups having 1 to 10 carbon atoms (such as methyl, ethyl, n-propyl, iso-propyl, n-hexyl, benzyl, n-butyl, alkylcarboxy groups, carboxyethyl, carboxybutyl, sulfobutyl, and sulfopropyl), substituted or unsubstituted aralkyl groups (such as benzyl and diphenylmethyl groups), or substituted or unsubstituted aryl groups having 6 to 10 carbon atoms in the aromatic ring system (such as phenyl, naphthyl, p-methylphenyl, 2,4-diethylphenyl, 2,4-dimethylphenyl, p-chlorophenyl, and 3-methoxyphenyl groups). Other useful alkyl and aryl groups would be readily apparent to one skilled in the art. More preferably, $P_{15}$ and $P_{16}$ are independently substituted or unsubstituted alkyl groups having 1 to 6 carbon atoms, and even more preferably, $P_{15}$ and $P_{16}$ are independently substituted or unsubstituted methyl, ethyl, n-propyl, or n-butyl groups, or alkylcarboxy groups.

One preferred class of cyanine dyes useful as radiation absorbing compounds in this invention are the indolenine dyes that can be represented by the following Structure II.

II

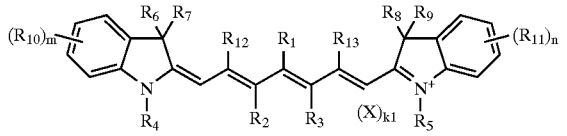

wherein $R_1$ represents hydrogen, halogen, alkyl, heterocyclyl, alkythio, arylthio, alkoxy, aryloxy, and amino groups, $R_2$, $R_3$, $R_{12}$, and $R_{13}$ independently represent hydrogen or $R_{12}$ and $R_1$, $R_2$ and $R_3$, or $R_1$ and $R_{13}$ taken together represent the atoms necessary to form a 5- or 6-membered carbocyclic or heterocyclic ring, or $R_{12}$, $R_1$ and $R_{13}$ may be joined to form fused rings that are also preferably 5- or 6-membered carbocyclic or heterocyclic rings, $R_4$ and $R_5$ independently represent alkyl, aryl, alkaryl, or heterocyclyl groups, $R_6$, $R_7$, $R_8$, and $R_9$ independently represent alkyl groups or aryl groups, or $R_6$ and $R_7$, and $R_8$ and $R_9$ can form a 5- or 6-membered carbocyclic or heterocyclic ring, $R_{10}$ and $R_{11}$ independently represent a substituted or unsubstituted alkyl, aryl, alkoxy, aryloxy, alkyl(or aryl)—$SO_2$—, fused carbocyclic, heterocyclic, or aromatic rings, halo, secondary or tertiary amino, heterocyclyl, alkyl(or aryl)—CO—, alkyl(or aryl)—COO, R"R'"NCO—, nitro, cyano, or R"R'"$NSO_2$— groups, R" and R'" are independently substituted or unsubstituted alkyl or aryl groups, m and n are each independently an integer from 0 to 4, X is an electric charge neutralizing counterion, and $k_1$ is an integer inclusive of 0 necessary to neutralize an electric charge in the molecule.

Preferably, $R_1$ represents hydrogen, halogen (including F, Cl, Br, and I), alkyl groups having 1 to 10 carbon atoms (for example, for example, methyl, ethyl, n-propyl, iso-propyl, n-hexyl, and n-butyl), heterocyclyl (for example, diazolyl and triazolyl), alkylthio (for example, methythio and ethylthio), arylthio (for example, phenylthio and p-methylphenylthio), alkoxy (for example, methoxy and ethoxy), aryloxy (for example, phenoxy and p-cyanophenoxy), alkylamino (for example, methylamino and ethylamino), arylamino (for example, phenylamino), dialkylamino (for example, dimethylamino and diethylamino), diarylamino (for example, diphenylamino), and alkylarylamino (for example, methylphenylamino). More preferably, $R_1$ represents halogen, a diazole, or a triazole group.

$R_2$, $R_3$, $R_{12}$ and $R_{13}$ may independently represent hydrogen. In addition, $R_{12}$ and $R_1$, or $R_2$ and $R_3$, or $R_1$ and $R_{13}$ taken together represent the atoms necessary to form a 5- or 6-membered carbocyclic or heterocyclic ring, or $R_{12}$, $R_1$, and $R_{13}$ may be joined to form fused rings that are also preferably 5- or 6-membered carbocyclic or heterocyclic rings. Such rings may also contain additional substituent groups (for example, methyl, gem-dimethyl, methylthio, phenylthio, or diphenylamino).

$R_4$ and $R_5$ independently represent alkyl groups having 1 to 20 carbon atoms (for example, methyl, ethyl, n-propyl, i-propyl, n-hexyl, n-butyl, octadecyl, carboxy, carboxyethyl, carboxybutyl, sulfobutyl, sulfopropyl, —$SO_2$-alkyl, and phenylmethylene groups) or aryl groups having 6 to 10 carbon atoms in the aromatic ring system (such as phenyl, naphthyl, p-methylphenyl, 2,4-diethylphenyl, 2,4-dimethylphenyl, p-chlorophenyl, and 3-methoxyphenyl groups). Other useful alkyl and aryl groups would be readily apparent to one skilled in the art. Preferably, $R_4$ and $R_5$ independently represent unsubstituted alkyl groups having 1 to 6 carbon atoms, and more preferably, they independently represent methyl, ethyl, n-propyl, or n-butyl groups.

$R_6$, $R_7$, $R_8$, and $R_9$ independently represent alkyl groups having 1 to 10 carbon atoms (such as methyl, ethyl, n-propyl, iso-propyl, n-hexyl, n-butyl, carboxyethyl, carboxybutyl, sulfobutyl, sulfopropyl, —$SO_2$-alkyl, and phenylmethylene groups) or aryl groups having 6 to 10 carbon atoms in the aromatic ring system (such as phenyl, naphthyl, p-methylphenyl, 2,4-diethylphenyl, 2,4-dimethylphenyl, p-chlorophenyl, and 3-methoxyphenyl groups), or $R_6$ and $R_7$, and/or $R_8$ and $R_9$ together represent the necessary atoms to complete a 5- or 6-membered carbocyclic or heterocyclic ring. Other useful alkyl and aryl groups would be readily apparent to one skilled in the art. Preferably, $R_6$, $R_7$, $R_8$, and $R_9$ independently represent alkyl groups of up to 6 carbon atoms. More preferably $R_6$, $R_7$, $R_8$, and $R_9$ are each methyl groups Preferably, $R_{10}$ and $R_{11}$ independently represent hydrogen, fused carbocyclic, heterocyclic, or aromatic rings, halo (F, Cl, Br, and I), alkoxy, and phenylsulfonyl groups.

Another preferred class of cyanine dyes useful as radiation absorbing compounds in this invention are naphthoindolenine dyes that can be represented by the following Structure III.

III

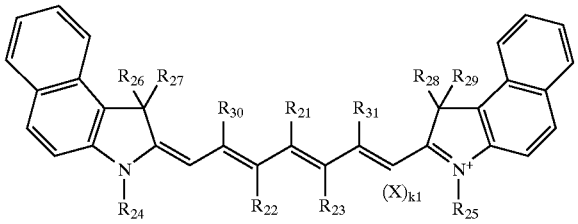

wherein $R_{21}$ represents hydrogen, halogen, alkyl, heterocyclyl, alkythio, arylthio, alkoxy, aryloxy, and amino groups, $R_{22}$, $R_{23}$, $R_{30}$, and $R_{31}$ independently represent hydrogen or $R_{30}$ and $R_{21}$, $R_{22}$ and $R_{23}$, or $R_{21}$ and $R_{31}$ taken together represent the atoms necessary to form a 5- or 6-membered carbocyclic or heterocyclic ring, or $R_{30}$, $R_{21}$ and $R_{31}$ may be joined to form fused rings that are also preferably 5- or 6-membered carbocyclic or heterocyclic rings, $R_{24}$ and $R_{25}$ independently represent alkyl, aryl, alkaryl, or heterocyclyl groups, $R_{26}$, $R_{27}$, $R_{28}$, and $R_{29}$ independently represent alkyl groups or aryl groups, or $R_{26}$ and $R_{27}$, and $R_{28}$ and $R_{29}$ can form a 5- or 6-membered carbocyclic or heterocyclic ring, X is an electric charge neutralizing counterion, and $k_1$ is an integer inclusive of 0 necessary to neutralize an electric charge in the molecule.

Preferably, $R_1$ represents hydrogen, halogen (including F, Cl, Br, and I), alkyl groups having 1 to 10 carbon atoms (for example, for example, methyl, ethyl, n-propyl, iso-propyl, n-hexyl, and n-butyl), heterocyclyl (for example, diazolyl and triazolyl), alkylthio (for example, methythio and ethylthio), arylthio (for example, phenylthio and p-methylphenylthio), alkoxy (for example, methoxy and ethoxy), aryloxy (for example, phenoxy and p-cyanophenoxy), alkylamino (for example, methylamino and ethylamino), arylamino (for example, phenylamino), dialkylamino (for example, dimethylamino and diethylamino), diarylamino (for example, diphenylamino), and alkylarylamino (for example, methylphenylamino). Preferably, $R_{21}$ represents hydrogen, an alkyl or an aryloxy group.

$R_{22}$, $R_{23}$, $R_{30}$, and $R_{31}$ may independently represent hydrogen. In addition, $R_{30}$, and $R_{21}$, or $R_{22}$, and $R_{23}$, or $R_{21}$, and $R_{31}$ taken together represent the atoms necessary to form a 5- or 6-membered carbocyclic or heterocyclic ring, or $R_{30}$, $R_{21}$ and $R_{31}$ may be joined to form fused rings that are also preferably 5- or 6-membered carbocyclic or heterocyclic rings. Such rings may contain additional substituent groups (for example, methyl, methylthio, phenylthio, or diphenylamino).

Preferably, $R_{24}$ and $R_{25}$ independently represent alkyl groups having 1 to 20 carbon atoms (such as methyl, ethyl, n-propyl, iso-propyl, n-hexyl, n-butyl, octadecyl, carboxy, carboxyethyl, carboxybutyl, sulfobutyl, sulfopropyl, —$SO_2$-alkyl, and phenylmethylene groups) or aryl groups having 6 to 10 carbon atoms in the aromatic ring system (such as phenyl, naphthyl, p-methylphenyl, 2,4-diethylphenyl, 2,4-dimethylphenyl, p-chlorophenyl, and 3-methoxyphenyl groups). Other useful alkyl and aryl groups would be readily apparent to one skilled in the art. More preferably, $R_{24}$ and $R_{25}$ independently represent unsubstituted alkyl groups having 1 to 6 carbon atoms, and more preferably, they independently represent methyl, ethyl, n-propyl, or n-butyl groups.

$R_{26}$, $R_{27}$, $R_{28}$, and $R_{29}$ independently represent alkyl groups having 1 to 10 carbon atoms (such as methyl, ethyl, n-propyl, iso-propyl, n-hexyl, n-butyl, carboxyethyl, carboxybutyl, sulfobutyl, sulfopropyl, —$SO_2$-alkyl, and phenylmethylene groups) or aryl groups having 6 to 10 carbon atoms in the aromatic ring system (such as phenyl, naphthyl, p-methylphenyl, 2,4-diethylphenyl, 2,4-dimethylphenyl, p-chlorophenyl, and 3-methoxyphenyl groups), or $R_{26}$ and $R_{27}$, and/or $R_{28}$ and $R_{29}$ together represent the necessary atoms to complete a 5- or 6-membered carbocyclic or heterocyclic ring. Other useful alkyl and aryl groups would be readily apparent to one skilled in the art. Preferably, $R_{26}$, $R_{27}$, $R_{28}$, and $R_{29}$ independently represent alkyl groups of up to 6 carbon atoms. More preferably $R_{26}$, $R_{27}$, $R_{28}$, and $R_{29}$ are each methyl groups A third preferred class of dyes useful as radiation absorbing compounds in this invention are benzothiazole dyes that can be represented by the following Structure IV.

IV

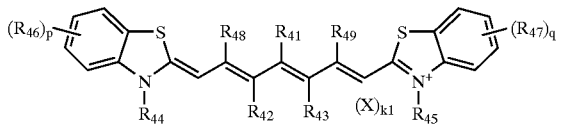

wherein $R_{41}$ represents hydrogen, alkyl, heterocyclyl, alkythio, arylthio, alkoxy, aryloxy, halo, and amino groups, $R_{42}$, $R_{43}$, $R_{48}$, and $R_{49}$, independently represent hydrogen, or $R_{48}$ and $R_{41}$, or $R_{42}$ and $R_{43}$, or $R_{41}$ and $R_{49}$, taken together represent the atoms necessary to form a 5- or 6-membered carbocyclic or heterocyclic ring, or $R_{48}$, $R_{41}$ and $R_{49}$ may be joined to form fused rings that are also preferably 5- or 6-membered carbocyclic or heterocyclic rings, $R_{44}$ and $R_{45}$ independently represent alkyl, aryl, alkaryl, or heterocyclyl groups, $R_{46}$ and $R_{47}$ independently represent a substituted or unsubstituted alkyl, aryl, alkoxy, aryloxy, alkyl(or aryl)—$SO_2$—, fused carbocyclic, heterocyclic, or aromatic rings, halo, secondary or tertiary amino, heterocyclyl, alkyl(or aryl)—CO—, alkyl(or aryl)—COO, R"R'"NCO—, nitro, cyano, or R"R'"$NSO_2$— groups, R" and R'" are independently substituted or unsubstituted alkyl or aryl groups, p and q are each independently an integer from 0 to 4, X is an electric charge neutralizing counterion, and $k_1$ is an integer inclusive of 0 necessary to neutralize an electric charge in the molecule.

Preferably, $R_{41}$ represents hydrogen, alkyl (for example, alkyl groups having 1 to 10 carbon atoms, alkylamino (for example, methylamino and ethylamino), arylamino (for example, phenylamino), dialkylamino (for example, dimethylamino and diethylamino), diarylamino (for example, diphenylamino), and alkylarylamino (for example, methylphenylamino). Preferably, $R_{41}$ represents a methyl, ethyl, n-propyl, iso-propyl, n-hexyl, n-butyl, or diphenylamino group. More preferably, $R_{41}$ represents a methyl group or a diphenylamino group.

$R_{42}$, $R_{43}$, $R_{48}$, and $R_{49}$ may independently represent hydrogen. In addition, $R_{48}$ and $R_{41}$, $R_{42}$ and $R_{43}$, or $R_4$, and $R_{49}$ taken together represent the atoms necessary to form a 5- or 6-membered carbocyclic or heterocyclic ring, or $R_{48}$, $R_{41}$, and $R_{49}$ may be joined to form fused rings that are also preferably 5- or 6-membered carbocyclic or heterocyclic rings. Such rings may also contain additional substituent groups (for example, methyl, gem-dimethyl, methylthio, phenylthio, or diphenylamino).

Preferably, $R_{44}$ and $R_{45}$ independently represent alkyl groups having 1 to 20 carbon atoms (such as methyl, ethyl, n-propyl, iso-propyl, n-hexyl, n-butyl, carboxy, carboxyethyl, carboxybutyl, sulfobutyl, sulfopropyl, —$SO_2$-alkyl, and phenylmethylene groups) or aryl groups having 6 to 10 carbon atoms in the aromatic ring system (such as phenyl, naphthyl, p-methylphenyl, 2,4-diethylphenyl, 2,4-dimethylphenyl, p-chlorophenyl, and 3-methoxyphenyl groups). Other useful alkyl and aryl groups would be readily apparent to one skilled in the art. More preferably, $R_{34}$ and $R_{35}$ independently represent unsubstituted alkyl groups having 1 to 6 carbon atoms, and more preferably, they independently represent methyl, ethyl, n-propyl, or n-butyl groups.

Preferably, $R_{46}$ and $R_{47}$ independently represent hydrogen, fused carbocyclic, heterocyclic, or aromatic rings, and halo (F, Cl, Br, and I) groups.

As noted above, in Structures I, II, III, and IV, X represents a suitable charge-neutralizing counterion, anion or cation, or combination thereof, and $k_1$ is an integer inclusive of 0 sufficient to neutralize an electric charge in the molecule. Whether a certain dye is a cation or anion, or whether or not a certain dye has a net ionic charge, depends on its structure and substituents. The cation is typically an inorganic or organic ammonium ion or alkali metal ion, including, but not limited to, alkali metal cations, ammonium, alkylammonium, dialkylammonium, trialkylammonium, and tetraalkylammonium. The anion may be either an inorganic or an organic anion, such as halide, alkylsulfonate, arylsulfonate, aryldisulfonate, alkylsulfate, sulfate ion, thiocyanate ion, perchlorate ion, tetrafluoroborate ion, picrate ion, acetate ion, hexafluorophosphate, hexafluoroantimonate and trifluoromethanesulfonate ion. Preferred anions are halide, perchlorate, and p-toluenesulfonate ions. In addition, $k_1$ is selected so that the compounds represented in Structure I have a total net charge of zero. Anions having a single negative charge and represented by the formula $X^-$ are preferred.

Representative radiation absorbing compounds are the following Compounds AD-1 to AD-45. These compounds may be used alone or in mixtures. As shown in the examples below, some routine experimentation may be needed to determine the compound and the appropriate amount to provide both the desired absorbance (hence, mottle control) and minimal loss in sensitivity.

AD-1

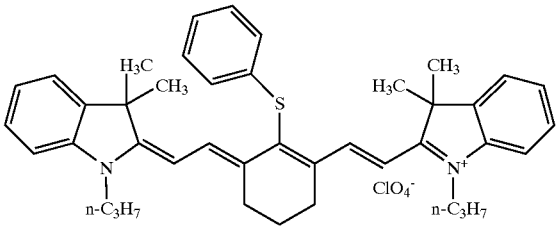

AD-02

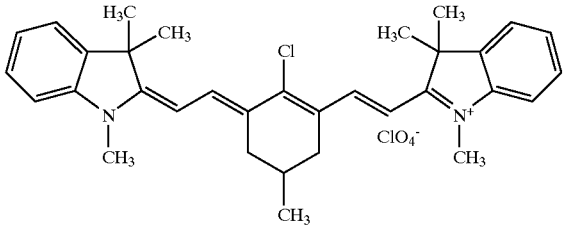

-continued
AD-3
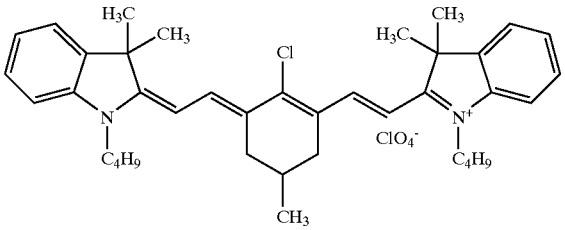
AD-4
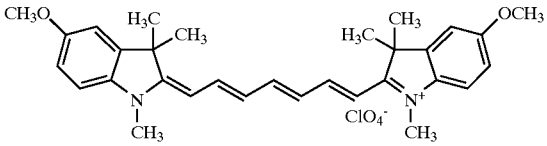
AD-5
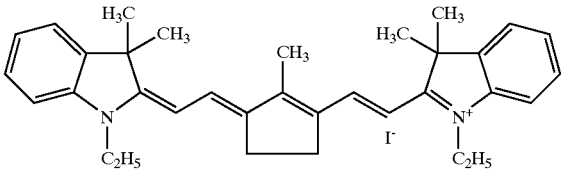
AD-6
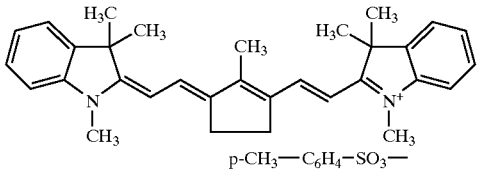
AD-7
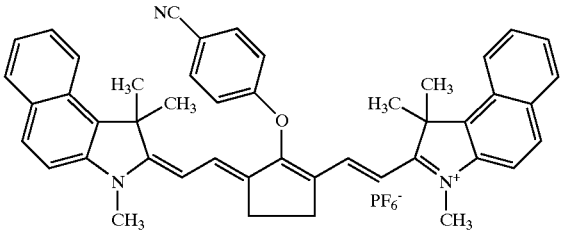
AD-8
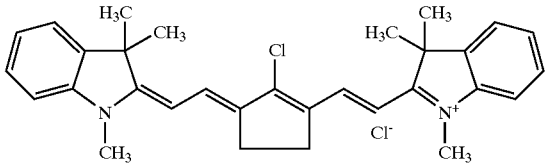
AD-9
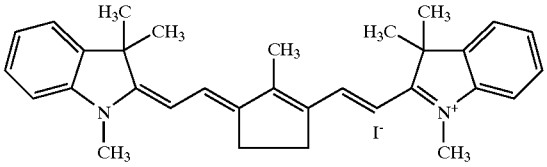
AD-10
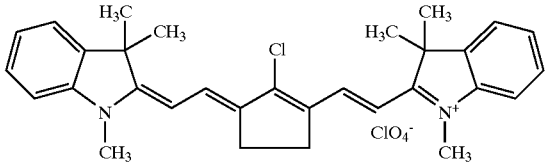
AD-11
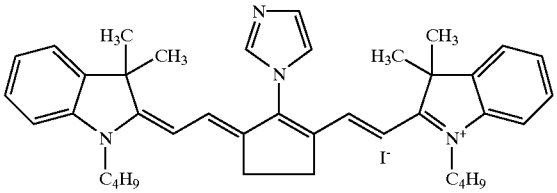
AD-12
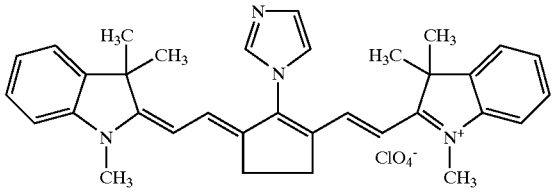
AD-13
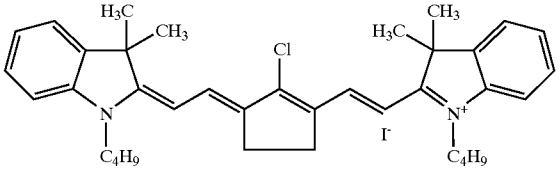
AD-14
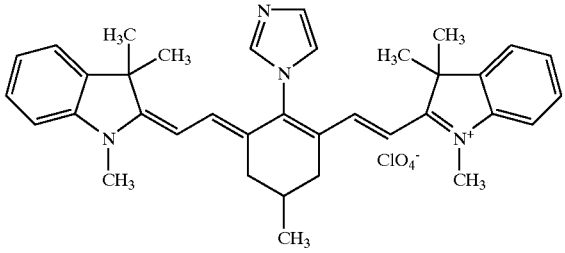

-continued
AD-15
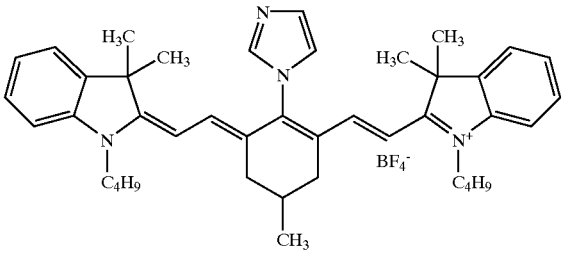
AD-16
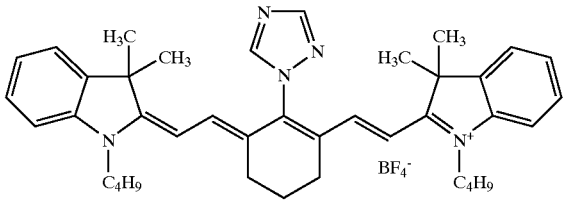
AD-17
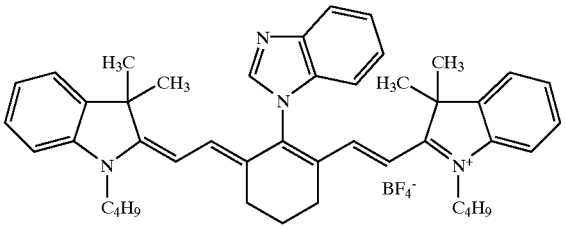
AD-18
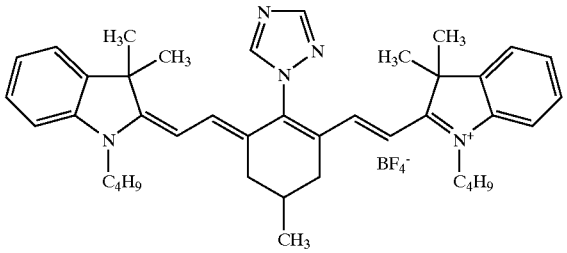
AD-19
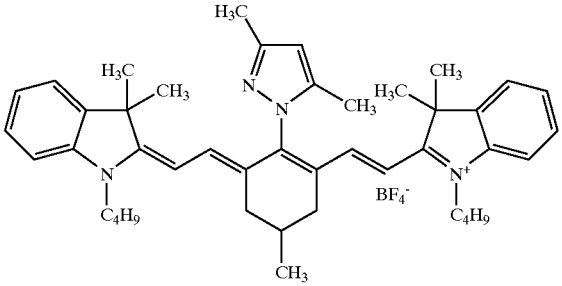
AD-20
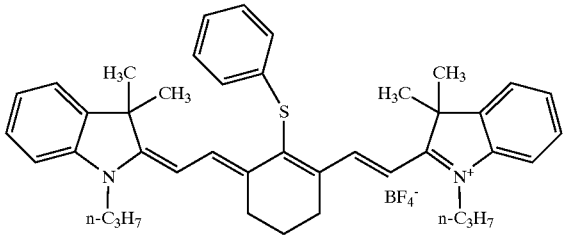
AD-21
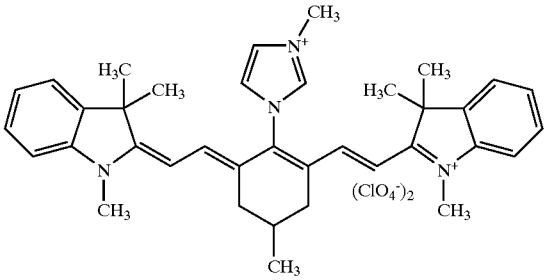
AD-22
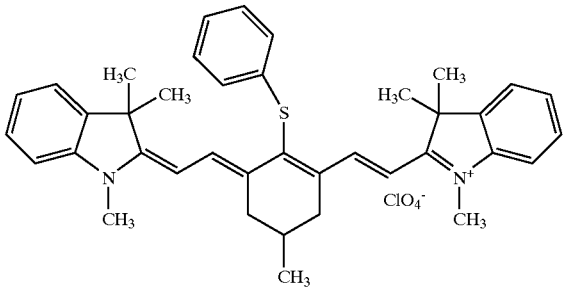
AD-23
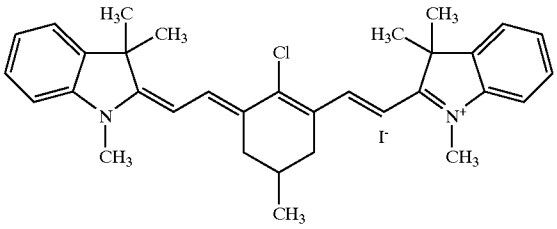
AD-24
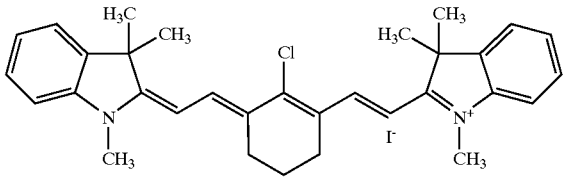

-continued
AD-25
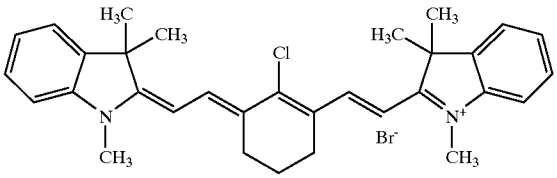
AD-26
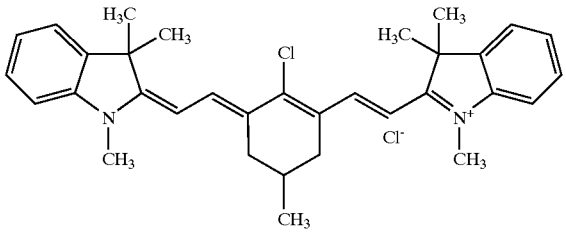
AD-27
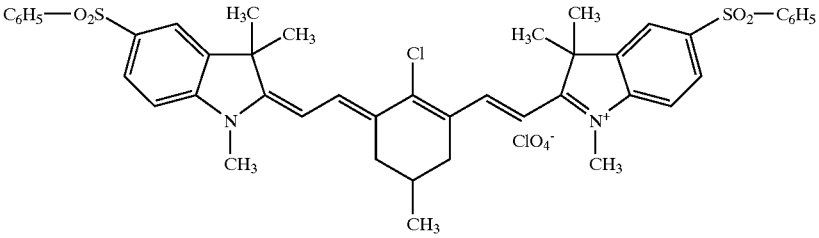
AD-28
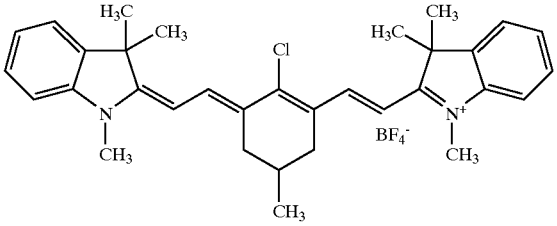
AD-29
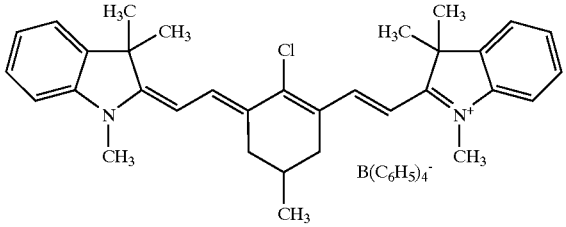
AD-30
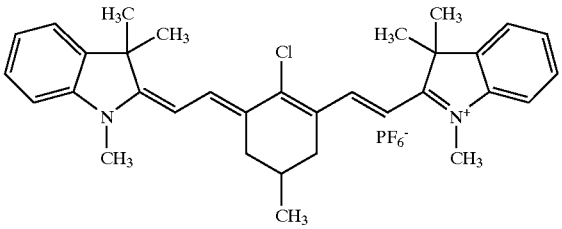
AD-31
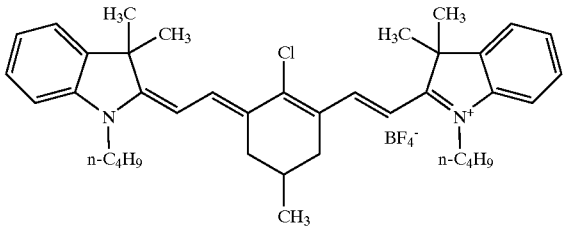
AD-32
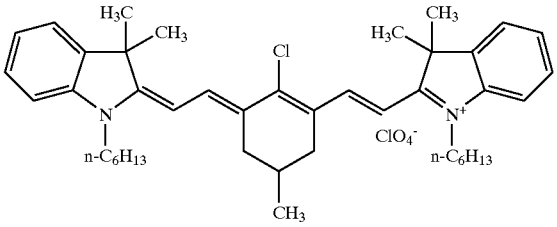
AD-33
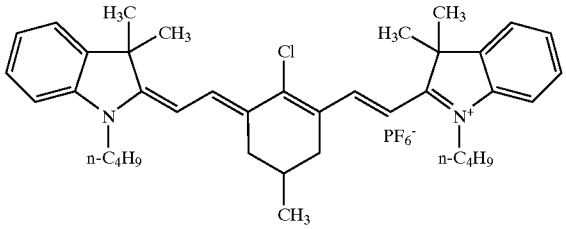
AD-34
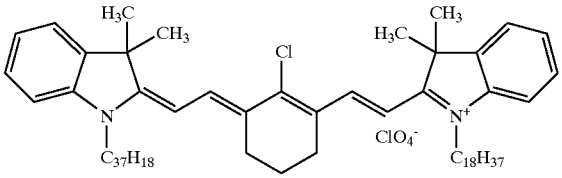
AD-35
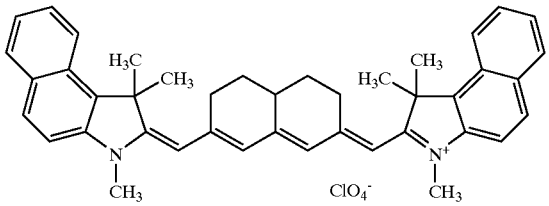

-continued

AD-36

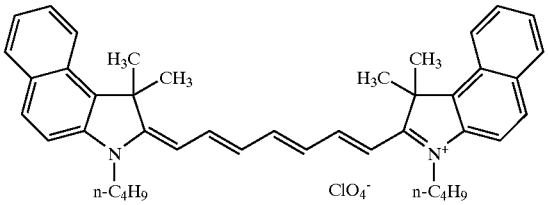

AD-37

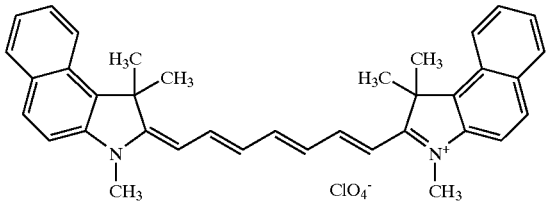

AD-38

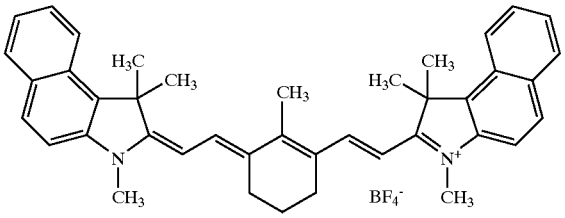

AD-39

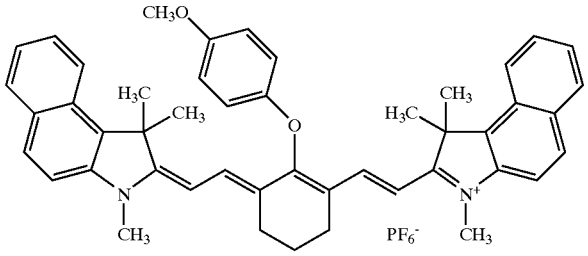

AD-40

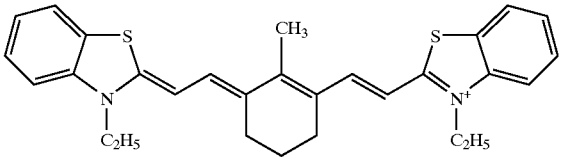

AD-41

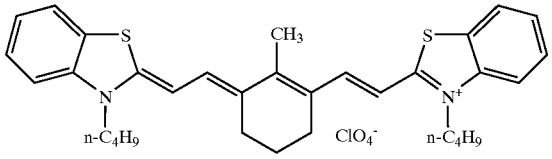

AD-42

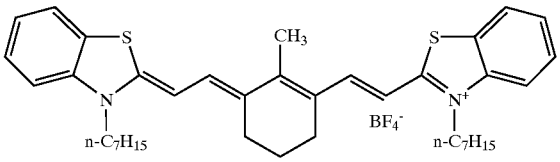

AD-43

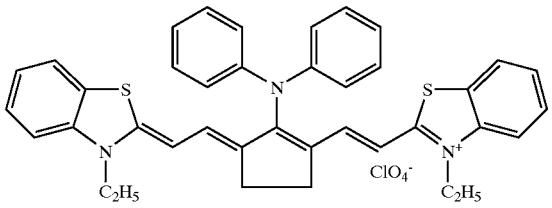

AD-44

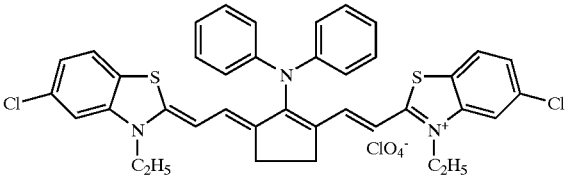

AD-45

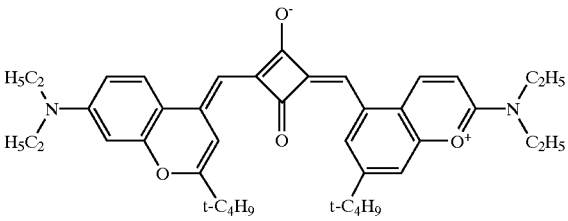

The various radiation absorbing compounds useful in the practice of the present invention can be obtained from a number of commercial sources, or prepared using procedures that are well known in the art, including those procedures described for example in EP-A-0 342 810 (Leichter) and U.S. Pat. No. 5,541,054(noted above) for benzothiazole dyes as well as those described in, for example, F. M. Hamer, *Cyanine Dyes and Related Compounds*, John Wiley & Sons, New York, 1964, K. Venkataraman, *The Chemistry of Synthetic Dyes*, Academic Press, New York, Volume II, Chapter XXXVIII, pp. 1143–1186, G. and E. Ficken, *The Chemistry of Synthetic Dyes*, K. Venkataraman, Ed., Academic Press, New York, 1971, Volume IV, Chapter V, pp. 211–340, and references cited therein.

In addition, the desired level of absorbance can be provided by the addition of one or more radiation absorbing compounds from other classes of dye compounds, for example squaraines, cyanines, hemicyanines, merocyanines, and oxanols.

Other Addenda

The photothermographic materials of the invention can also contain other additives such as shelf-life stabilizers, toners, antifoggants, contrast enhancers, development accelerators, acutance dyes, post-processing stabilizers or stabilizer precursors, and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae: Ar—S—M and Ar—S—S—Ar, wherein M represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. For example, heteroaromatic mercapto compounds are described as supersensitizers for infrared photothermographic materials in EP-A-0 559 228. (Philip Jr. et al.).

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

The photothermographic materials of the present invention can be further protected against the production of fog and can be stabilized against loss of sensitivity during storage. While not necessary for the practice of the invention, it may be advantageous to add mercury(II) salts to the emulsion layer(s) as an antifoggant. Preferred mercury (II) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum and gold salts as described in U.S. Pat. No. 2,566,263 (Trirelli) and U.S. Pat. No. 2,597,915 (Damshroder), compounds having —$SO_2CBr_3$ groups as described for example in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al.).

Furthermore, other specific useful antifoggants/stabilizers are described in more detail in U.S. Pat. No. 6,083,681 (Lynch et al.), incorporated herein by reference.

Other antifoggants are hydrobromic acid salts of heterocyclic compounds (such as pyridinium hydrobromide perbromide) as described, for example, in U.S. Pat. No. 5,028,523 (Skoug), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in EP-A-0 600 589 (Philip, Jr. et al.) and EP-A-0 600 586 (Philip, Jr. et al.), and tribromomethylketones as described, for example, in EP-A-0 600 587 (Oliff et al.).

Preferably, the photothermographic materials include one or more polyhalo antifoggants that include one or more polyhalo substituents including but not limited to, dichloro, dibromo, trichloro, and tribromo groups. The antifoggants can be aliphatic, alicyclic, or aromatic compounds, including aromatic heterocyclic and carbocyclic compounds.

Particularly useful antifoggants are polyhalo antifoggants, such as those having a —$SO_2C(X')_3$ group wherein X' represents the same or different halogen atoms.

The use of "toners" or derivatives thereof that improve the image is highly desirable. Preferably, if used, a toner can be present in an amount of about 0.01% by weight to about 10%, and more preferably about 0.1% by weight to about 10% by weight, based on the total dry weight of the layer in which it is included. Toners may be incorporated in the photothermographic emulsion layer or in an adjacent layer. Toners are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.), and GB 1,439,478 (Agfa-Gevaert).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt (3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides [such as (N,N-dimethylaminomethyl)phthalimide, and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethylpyrazole), 1,8-(3,6-diazaoctane)bis(isothiuronium) trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidinedione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in situ [such as ammonium hexachlororhodate(III), rhodium bromide, rhodium nitrate, and potassium hexachlororhodate(III)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazine and phthalazine derivatives [such as those described in U.S. Pat. No. 6,146,822 (noted above), incorporated herein by reference] are particularly useful toners.

Binders

The photocatalyst (such as photosensitive silver halide), the non-photosensitive source of reducible silver ions, the reducing agent composition, and any other additives used in the present invention are generally added to one or more binders that are either hydrophilic or hydrophobic. Thus, either aqueous or solvent-based formulations can be used to prepare the photothermographic materials of this invention. Mixtures of either or both types of binders can also be used. It is preferred that the binder be selected from hydrophobic polymeric materials, such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR™ B79 (Solutia, Inc.) and Pioloform™ BS-18 or Pioloform™ BL-16 (Wacker Chemical Company). Aqueous dispersions (or latexes) of hydrophobic binders may also be used.

Examples of useful hydrophilic binders include, but are not limited to, gelatin and gelatin-like derivatives (hardened or unhardened), cellulosic materials such as hydroxymethyl cellulose, acrylamide/methacrylamide polymers, acrylic/methacrylic acid polymers, polyvinyl pyrrolidones, polyvinyl alcohols and polysaccharides (such as dextrans and starch ethers).

Hardeners for various binders may be present if desired. Useful hardeners are well known and include diisocyanate compounds as described for example, in EP-0 600 586B1 and vinyl sulfone compounds as described in EP-0 600 589B1.

Where the proportions and activities of the photothermographic materials require a particular developing time and temperature, the binder(s) should be able to withstand those conditions. Generally, it is preferred that the binder does not decompose or lose its structural integrity at 120° C. for 60 seconds. It is more preferred that it does not decompose or lose its structural integrity at 177° C. for 60 seconds.

The polymer binder(s) is used in an amount sufficient to carry the components dispersed therein. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

Support Materials

The photothermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is the most preferred support. Various support materials are described, for example, in *Research Disclosure*, August 1979, item 18431. A method of making dimensionally stable polyester films is described in *Research Disclosure*, September 1999, item 42536.

Opaque supports can also be used, such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Support materials may also be treated or annealed to reduce shrinkage and promote dimensional stability.

Photothermographic Formulations

The formulation for the photothermographic emulsion layer(s) can be prepared by dissolving and dispersing the binder, the photocatalyst, the non-photosensitive source of reducible silver ions, the reducing composition, and optional addenda in an organic solvent, such as toluene, 2-butanone (methyl ethyl ketone), acetone, or tetrahydrofuran.

Alternatively, these components can be formulated with a hydrophilic binder in water or water-organic solvent mixtures to provide aqueous-based coating formulations.

Photothermographic materials of the invention can contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads, including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and image density uniformity as described in U.S. Pat. No. 5,468,603 (Kub).

EP-0 792 476 B1 (Geisler et al.) describes various means of modifying photothermographic materials to reduce what is known as the "woodgrain" effect, or uneven image density. This effect can be reduced or eliminated by several means, including treatment of the support, adding matting agents to the topcoat, using acutance dyes in certain layers, or other procedures described in the noted publication.

The photothermographic materials of this invention can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP-A-0 678 776 (Melpolder et al.). Other antistatic agents are well known in the art.

The photothermographic materials can be constructed of one or more layers on a support. Single layer materials should contain the photocatalyst, the non-photosensitive source of reducible silver ions, the reducing composition, the binder, as well as optional materials such as toners, acutance dyes, coating aids and other adjuvants.

Two-layer constructions comprising a single imaging layer coating containing all the ingredients and a surface protective topcoat are generally found in the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

Layers to promote adhesion of one layer to another in photothermographic materials are also known, as described for example, in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example, in U.S. Pat. No. 5,928,857 (Geisler et al.).

Layers to reduce emissions from the film may also be present, including the polymeric barrier layers described in U.S. Pat. No. 6,352,819 (Kenney et al.), and U.S. Pat. No. 6.420.102 (Bauer et al.), all incorporated herein by reference.

Photothermographic formulations described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers, described above, may be used. Such formulations are described in commonly assigned U.S. Pat. No. 6,355,405 (Ludemann et al.).

Preferably, two or more layers are applied to a film support using slide coating. The first layer can be coated on top of the second layer while the second layer is still wet. The first and second fluids used to coat these layers can be the same or different organic solvents (or organic solvent mixtures).

While the first and second layers can be coated on one side of the film support, a manufacturing method can also include forming on the opposing or backside of said polymeric support, one or more additional layers, including an antihalation layer, an antistatic layer, or a layer containing a matting agent (such as silica), or a combination of such layers. It is also contemplated that the photothermographic materials of this invention can include emulsion layers on both sides of the support.

In preferred embodiments, the photothermographic materials of this invention include a surface protective layer on the same side of the support as the one or more thermally-developable layers, an antihalation layer on the opposite side of the support, or both a surface protective layer and an antihalation layer on their respective sides of the support.

To further promote image sharpness, photothermographic materials according to the present invention can contain one or more layers containing antihalation dyes. These dyes are chosen to have absorption close to an exposure wavelength and are designed to absorb scattered light. One or more antihalation dyes may be incorporated into one or more antihalation layers according to known techniques, as an antihalation backing layer, as an antihalation underlayer, or as an antihalation overcoat. It is preferred that the photothermographic materials of this invention contain an antihalation coating on the support opposite to the side on which the emulsion and topcoat layers are coated.

Dyes particularly useful as antihalation dyes include dihydroperimidine squaraine dyes having the squaraine nucleus exemplified below in Compound CD-1. One particularly useful dihydroperimidine squaraine dye is cyclobutenediylium, 1,3-bis[2,3-dihydro-2,2-bis[[1-oxohexyl)oxy]methyl]-1H-perimidin-4-yl]-2,4-dihydroxy-, bis(inner salt) that is also shown below as radiation absorbing compound CD-1.

The indolenine dyes described above as radiation absorbing compounds can also be used as antihalation dyes in a backside layer of the photothermographic materials.

It is also useful in the present invention to employ antihalation dye systems that will decolorize or bleach with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), and EP-A-0 911 693 (Sakurada et al.).

Additional heat-bleachable antihalation systems include hexaarylbiimidazoles (HABI's) used in combination with certain oxonol dyes as described for example in U.S. Ser. No. 09/875,772 (filed Jun. 6, 2001 by Goswami, Ramsden, Zielinski, Baird, Weinstein, Helber, and Lynch), or other dyes described for example in U.S. Pat. No. 6.514,677 (Ramsden et al.), both incorporated herein by reference.

Imaging/development

Generally, the materials of this invention are sensitive to radiation in the range of from about 300 to about 850 nm. Imaging can be achieved by exposing the photothermographic materials to a suitable source of radiation to which they are sensitive (typically some type of radiation or electronic signal), including ultraviolet light, visible light, near infrared radiation, and infrared radiation to provide a latent image.

While the imaging materials of the present invention can be imaged in any suitable manner consistent with the type of material using any suitable imaging source (typically some type of radiation or electronic signal), the following discussion will be directed to the preferred imaging means. Generally, the materials are sensitive to radiation in the range of from about 300 to about 850 nm.

Imaging can be achieved by exposing the photothermographic materials of this invention to a suitable source of radiation to which they are sensitive, including ultraviolet light, visible light, near infrared radiation and infrared radiation to provide a latent image. Suitable exposure means are well known and include laser diodes that emit radiation in the desired region, photodiodes and others described in the art, including *Research Disclosure*, Vol. 389, September 1996, item 38957, (such as sunlight, xenon lamps, infrared lamps, and fluorescent lamps). Particularly useful exposure means uses laser diodes, including laser diodes that are modulated to increase imaging efficiency using what is known as multilongitudinal exposure techniques as described in U.S. Pat. No. 5,780,207 (Mohapatra et al.). Other exposure techniques are described in U.S. Pat. No. 5,493,327 (McCallum et al.).

In one embodiment, the photothermographic materials of this invention are sensitive to infrared radiation at a wavelength of at least 700 nm, and preferably at a wavelength of from about 750 to about 1400 nm (more preferably from about 750 to about 850 nm). In this embodiment, imaging can be achieved by exposure to any source of infrared radiation, including: an infrared laser, an infrared laser diode, an infrared light-emitting diode, an infrared lamp, or any other infrared radiation source readily apparent to one skilled in the art, and others described in the art, such as in *Research Disclosure*, September, 1996, item 38957.

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example, at about 150° C. for up to 10 seconds), followed by thermal diffusion at a lower temperature (for example, at about 80° C.) in the presence of a transfer solvent.

Use as a Photomask

The photothermographic materials of the present invention are sufficiently transmissive in the range of from about 350 to about 450 nm in non-imaged areas to allow their use in a process where there is a subsequent exposure of an ultraviolet or short wavelength visible radiation sensitive imageable medium. For example, imaging the photothermographic material and subsequent development affords a visible image. The heat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This process is particularly useful where the imageable medium comprises a printing plate and the photothermographic material serves as an imagesetting film.

The present invention also provides a method for the formation of a visible image (usually a black-and-white image) by first exposing to electromagnetic radiation and thereafter heating the inventive photothermographic material. In one embodiment, the present invention provides a method comprising:

A) imagewise exposing the photothermographic material of this invention to electromagnetic radiation to which the photocatalyst (for example, a photosensitive silver halide) of the material is sensitive, to generate a latent image, and B) simultaneously or sequentially, heating the exposed material to develop the latent image into a visible image.

This visible image can also be used as a mask for exposure of other photosensitive imageable materials, such as graphic arts films, proofing films, printing plates and circuit board films, that are sensitive to suitable imaging radiation (for example, UV radiation). This can be done by imaging an imageable material (such as a photopolymer, a diazo material, a photoresist, or a photosensitive printing plate) through the exposed and heat-developed photothermographic material. Thus, in some other embodiments wherein the photothermographic material comprises a transparent support, the image-forming method further comprises:

C) positioning the exposed and heat-developed photothermographic material between a source of imaging radiation and an imageable material that is sensitive to the imaging radiation, and D) exposing the imageable material to the imaging radiation through the visible image in the exposed and heat-developed photothermographic material to provide an image in the imageable material.

The following examples are provided to illustrate the practice of this invention, and are not intended to be limiting in any manner. The examples provide exemplary synthetic and preparatory procedures using the indolenine post-processing stabilizing compounds within the scope of the present invention.

MATERIALS AND METHODS FOR THE EXAMPLES

All materials used in the following examples are readily available from standard commercial sources, such as Aldrich Chemical Co. (Milwaukee Wis.) unless otherwise specified. All percentages are by weight unless otherwise indicated. The following additional terms and materials were used.

ACRYLOID™ A-21 or PARALOID™ A-21 is an acrylic copolymer available from Rohm and Haas (Philadelphia, Pa.).

CAB 171-15S is a cellulose acetate butyrate resin available from Eastman Chemical Co (Kingsport, Tenn.).

DESMODUR™ N3300 is an aliphatic hexamethylene diisocyanate available from Bayer Chemicals (Pittsburgh, Pa.).

LOWINOX™ 221B446 is 2,2'-isobutylidene-bis(4,6-dimethylphenol) available from Great Lakes Chemical (West Lafayette, Ind.).

PIOLOFORM™ BL-16 and BS-18 are a polyvinyl butyral resins available from Wacker Polymer Systems (Adrian, Mich.).

MEK is methyl ethyl ketone (or 2-butanone).

Sensitizing Dye A has the structure shown below.

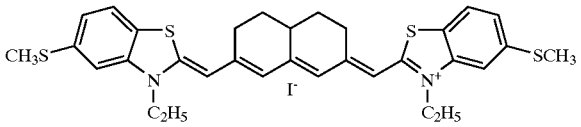

Vinyl Sulfone-1 (VS-1) is described in U.S. Pat. No. 6,143,487 and has the structure shown below.

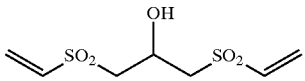

Antifoggant A is 2-(tribromomethylsulfonyl)quinoline and has the structure shown below.

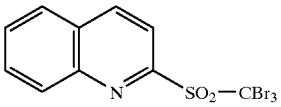

Antifoggant B is ethyl-2-cyano-3-oxobutanoate. It is described in U.S. Pat. No. 5,686,228 and has the structure shown below.

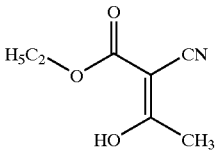

Compound HC-1 is described in U.S. Pat. No. 5,545,515 (noted above) and has the structure shown below.

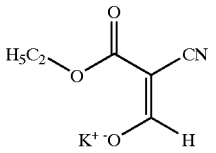

The following Comparative Dyes were used:

CD-1

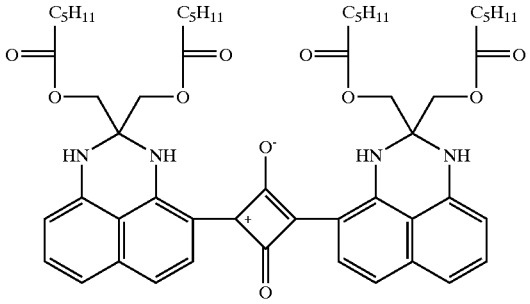

CD-2

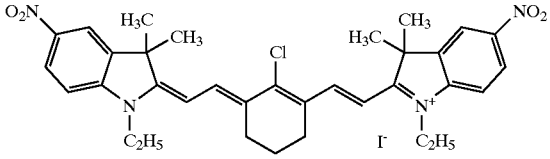

CD-3

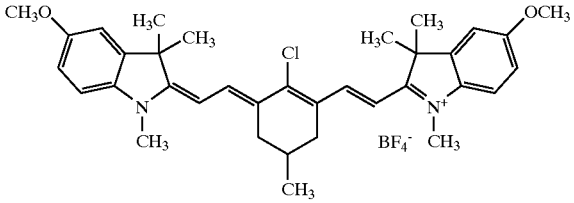

CD-4

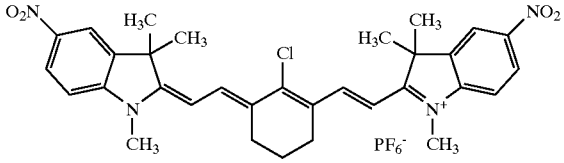

CD-5

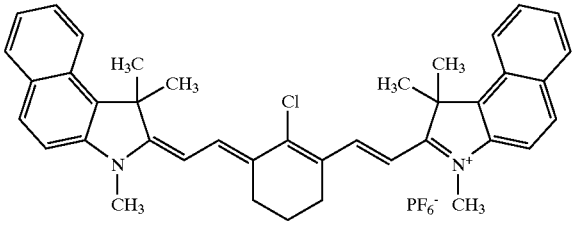

CD-6

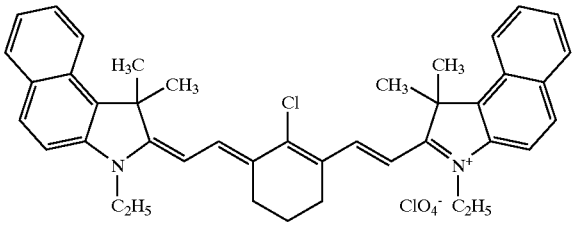

-continued

CD-7

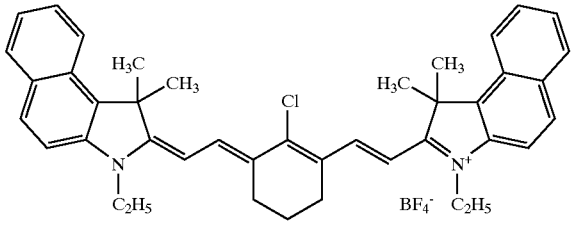

CD-8

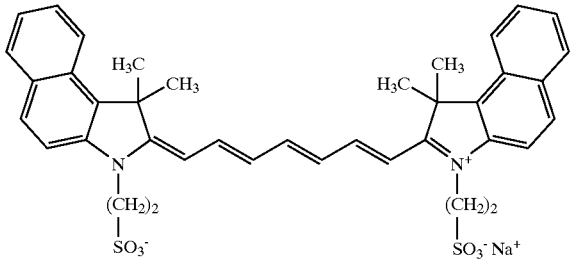

CD-9

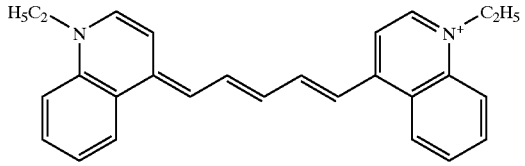

CD-10

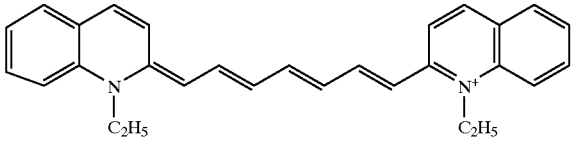

Example 1

A photothermographic imaging formulation was prepared as follows:

An emulsion of silver behenate full soap containing preformed silver halide (prepared as described in U.S. Pat. No. 5,939,249, noted above) was homogenized to 28.1% solids in MEK containing Pioloform BS-18 polyvinyl butyral binder (4.4% solids). To 192 parts of this emulsion were added 1.6 parts of a 15% solution of pyridinium hydrobromide perbromide in methanol with stirring. After 60 minutes of mixing, 2.1 parts of an 11% zinc bromide solution in methanol was added. Stirring was continued and after 30 minutes, an addition to was made of a solution of 0.15 parts 2-mercapto-5-methylbenzimidazole, 0.007 parts Sensitizing Dye A, 1.7 parts of 2-(4-chlorobenzoyl)benzoic acid, 10.8 parts of methanol, and 3.8 parts of MEK.

After stirring for another 75 minutes, 41 parts of Pioloform BL-16 was added and the temperature was reduced to 10° C., and mixing was continued for another 30 minutes.

At this time, the photothermographic imaging formulation was completed by adding Solution A, LOWINOX™, Solution B, and Solution C. These materials were added 5 minutes apart. Mixing was maintained.

| | |
|---|---|
| Solution A: | |
| Antifoggant A: | 1.3 parts |
| Tetrachlorophthalic acid | 0.37 parts |
| 4-Methylphthalic acid | 0.60 parts |
| MEK | 20.6 parts |
| Methanol | 0.36 parts |
| LOWINOX ™ 221B446 | 9.5 parts |
| Solution B: | |
| DESMODUR ™ N3300 | 0.66 parts |
| MEK | 0.33 parts |
| Solution C: | |
| Phthalazine | 1.3 parts |
| MEK | 6.3 parts |

A stock solution formulation for the protective topcoat for the photothermographic emulsion layer was prepared as follows:

| Protective topcoat Formulation: | |
|---|---|
| ACRYLOID A-21 | 1.3 parts |
| CAB 171-15S | 32.8 parts |
| MEK | 377 parts |
| Vinyl sulfone (VS-1) | 0.95 parts |
| Benzotriazole | 0.71 parts |
| Antifoggant B | 0.63 parts |

Twelve different topcoat formulations were prepared using this solution. For Control A, 3.1 parts MEK was added to 14.9 parts of the topcoat formulation. For samples 1-1 to 1-11, a solution comprising the radiation absorbing compound (and amount) listed in TABLE I with 3.1 parts MEK was added to 14.9 parts of the topcoat formulation noted above.

The imaging (silver) and topcoat formulations were simultaneously dual knife coated onto a 178 $\mu$m polyethylene terephthalate support to provide photothermographic materials with the topcoat being farthest from the support. The web (support and applied layers) was conveyed at a rate of 5 meters per minute during coating and drying. Simultaneous coating allowed the radiation absorbing compound in the topcoat formulation to diffuse down into the imaging layer formulation before drying. Immediately after coating, the samples were dried in an oven at about 85° C. for 5 minutes. The imaging layer formulation was coated to provide about 2 g of silver/$m^2$ dry coating weight. The topcoat formulation was coated to provide about 2.6 g/$m^2$ dry coating weight.

Upon exposure and development, this material was capable of achieving an optical density of about 4.0.

The backside of the support was coated with a conventional antihalation layer to provide an absorbance greater than 0.3 between 805 and 815 nm. This absorbance is not included in the absorbance reported in the examples for the frontside of the photothermographic materials.

Part of each photothermographic material prepared in this fashion was cut into an "imaging sample" 1 cm×5 cm in size. In addition, a sample of the support used for the photothermographic material coated only on the backside with the antihalation formulation and without imaging or topcoat coatings was cut into a "support sample" 1 cm×5 cm in size. This "support sample" was placed in the reference sample cell of a conventional spectrophotometer (U-3410, Hitachi).

The "imaging sample" was placed in the sample cell and the absorbance at an exposure wavelength of 810 nm was measured with the reference automatically subtracted, to give the absorbance of the imaging and topcoat layers. Because the topcoat layer is so thin compared to the imaging layer, and the dyes used quickly diffuse into the imaging layer during coating, this measured absorbance essentially equals the absorbance of each sample's imaging layer.

For Samples 1-1 to 1-11, a part of each photothermographic material was also cut into a 20×25 cm sheet, exposed uniformly with a conventional laser imager at 810 nm, and heat-developed for 15 seconds at 122° C. to generate an image with an optical density of about 3.0. Thus, the materials in these examples were imaged and developed to an optical density below that of which the material was capable. The imaged sheets were viewed in transmission mode with a high intensity light source and they were ranked for their mottle appearance according to the following scale:

Grade=1: extremely gross mottle, worst of all samples

Grade=2: noticeably better than Grade=1

Grade=3: noticeably better than Grade=2

Grade=4: noticeably better than Grade=3

Grade=5: noticeably better than Grade=4

Grade=6: noticeably better than Grade=5

Grade=7: noticeably better than Grade=6, barely perceptible mottle, best of all samples.

The mottle evaluation for each photothermographic material, shown below in TABLE I, demonstrates that as absorbance increases, mottle is reduced. This occurs regardless of the class of dye used. Dye concentrations that provided an absorbance greater than 0.6 worked well, and dye concentrations that provided an absorbance greater than 1.0 were particularly effective.

FIG. 1 graphically shows the relationship between absorbance and mottle ratings.

TABLE I

| Sample | Dye | Dye Amount | Absorbance | Mottle Rating* |
|---|---|---|---|---|
| Control A | None | — | 0.03 | 1 |
| 1-1 | CD-1 | 0.020 parts | 0.56 | 2 |
| 1-2 | CD-1 | 0.025 parts | 0.75 | 3 |
| 1-3 | AD-1 | 0.012 parts | 0.88 | 4 |
| 1-4 | AD-1 | 0.014 parts | 1.01 | 5 |
| 1-5 | AD-1 | 0.016 parts | 1.14 | 6 |
| 1-6 | AD-2 | 0.012 parts | 0.62 | 3 |
| 1-7 | AD-2 | 0.016 parts | 0.90 | 4 |
| 1-8 | AD-2 | 0.020 parts | 1.03 | 6 |
| 1-9 | AD-3 | 0.012 parts | 0.74 | 3 |
| 1-10 | AD-3 | 0.017 parts | 1.04 | 6 |
| 1-11 | AD-3 | 0.020 parts | 1.17 | 7 |

*Mottle Rating (1 is worst, 7 is best)

Example 2

Part of each photothermographic material prepared in Example 1 was again cut into strip samples 3.4×25.4 cm in size. These were labeled Control B (identical to Control A) and Examples 2-1 through 2-11 (identical to Samples 1-1 through 1-11). Each of these strips was exposed with a laser sensitometer at 810 nm and heat-developed for 15 seconds at 122° C. to generate continuous tone wedges with optical densities varying from a minimum density ($D_{min}$) to an optical density greater than 3.5. These wedges were then measured with a computer densitometer to obtain graphs of density verses log exposure in ergs/cm$^2$. The log of the exposure to reach a density of $1.0+D_{min}$ was measured to indicate the sensitivity of the film. In these samples, a lower exposure indicates a higher sensitivity.

Sensitivity loss due to addition of the radiation absorbing compound was calculated as:

the increase in the log of the exposure needed to reach a density of $1.0+D_{min}$, compared to Control B, divided by, the increase in the absorbance in the imaging layer at the imaging wavelength, compared to Control B.

Thus, a higher number indicates greater sensitivity loss from incorporating the radiation absorbing compound (dye) to provide a given absorbance. To significantly improve mottle without unacceptable loss of sensitivity, a compound causing a sensitivity loss of less than 0.4 is considered essential in the practice of this invention.

To illustrate this feature, for example a photothermographic material A may be designed to have an absorbance in the imaging layer of 0.0 at 810 nm. To produce a density of $1.0+D_{min}$ with this material, the log of the exposure required may be 3.0. A photothermographic material B is designed to be the same as photothermographic material A except that a particular dye (radiation absorbing compound) has been incorporated into the imaging layer to provide an absorbance therein of 1.2 at 810 nm. To produce a density of $1.0+D_{min}$ with photothermographic material B, the log of the exposure required may be 3.8. The sensitivity loss would then be the difference in the log of the exposure (3.8−3.0=0.8), divided by the difference in the absorbance in the imaging layer (1.2−0.0=1.2), which would be 0.8/1.2=0.67. While this dye may be useful for reducing mottle, it will do so with an undesirable sensitivity loss.

The results, shown below in TABLE II, show mottle evaluations and sensitivity losses for the various photothermographic materials. Some dyes exhibited unacceptable sensitivity loss, while still improving mottle. For example, Dye CD-1, a squaraine dye commonly used as an antihalation and acutance dye in photothermographic materials, caused a sensitivity loss greater than 0.4. However, indolenine dyes AD-1, AD-2, and AD-3 significantly reduced mottle and showed an acceptable sensitivity loss of less than 0.4.

TABLE II

| Sample | Dye | Absorbance | Mottle Rating* | Sensitivity Loss** | Comments |
|---|---|---|---|---|---|
| Control B | None | 0.03 | 1 | | |
| 2-1 | CD-1 | 0.56 | 2 | 0.48 | Comparative |
| 2-2 | CD-1 | 0.75 | 3 | 0.46 | Comparative |
| 2-3 | AD-1 | 0.88 | 4 | 0.30 | Invention |
| 2-4 | AD-1 | 1.01 | 5 | 0.28 | Invention |
| 2-5 | AD-1 | 1.14 | 6 | 0.27 | Invention |
| 2-6 | AD-2 | 0.62 | 3 | 0.14 | Invention |
| 2-7 | AD-2 | 0.90 | 4 | 0.13 | Invention |
| 2-8 | AD-2 | 1.03 | 6 | 0.13 | Invention |
| 2-9 | AD-3 | 0.74 | 3 | 0.17 | Invention |
| 2-10 | AD-3 | 1.04 | 6 | 0.16 | Invention |
| 2-11 | AD-3 | 1.17 | 7 | 0.15 | Invention |

*Mottle Rating (1 is worst, 7 is best)
**Sensitivity Loss (higher is worse)

Example 3

Photothermographic materials incorporating various radiation absorbing compounds within the imaging layer were prepared as described in Example 1. Control photothermographic materials were also prepared without radiation absorbing compounds, and the sensitivity losses were calculated to determine the usefulness of the radiation absorbing compound for reducing mottle. The compounds were diffused into the photothermographic materials from the topcoat formulation as described in Example 1 in an amount necessary to attain the absorbance at 810 nm as shown in TABLES III, IV, and V below. Each radiation absorbing compound was rated for sensitivity loss as described above.

The results, shown below in TABLE III demonstrate that photothermographic materials incorporating indolenine dyes without a center ring or with a five-carbon center ring provide sufficient absorbance to significantly reduce mottle without an unacceptably high sensitivity loss. It should also be noted that some radiation absorbing compounds are preferable over other compounds. Nevertheless, the most useful radiation absorbing compounds can be determined by routinely testing each compound for sensitivity loss.

TABLE III

| Sample | Dye | Absorbance | Sensitivity Loss | Comments |
|---|---|---|---|---|
| 3-1 | AD-4 | 1.15 | 0.31 | Invention |
| 3-2 | AD-5 | 1.41 | 0.12 | Invention |
| 3-3 | AD-6 | 1.00 | 0.13 | Invention |
| 3-4 | AD-7 | 1.15 | 0.19 | Invention |
| 3-5 | AD-8 | 1.31 | 0.21 | Invention |
| 3-6 | AD-9 | 1.40 | 0.22 | Invention |
| 3-7 | AD-10 | 1.24 | 0.29 | Invention |
| 3-8 | AD-11 | 1.06 | 0.31 | Invention |
| 3-9 | AD-12 | 1.10 | 0.34 | Invention |
| 3-10 | AD-13 | 1.06 | 0.35 | Invention |

Examples 3-20 to 3-19 in TABLE IV show that indolenine dyes having a six-carbon center ring can have an acceptable sensitivity loss for use at high absorbance in the imaging layer to significantly reduce mottle. However, some radiation absorbing compounds are preferable over others. For this group of dyes, heterocyclic substituents in the meso-position tended to provide better results than dyes having sulfur-containing substituents.

Examples 3-20 to 3-34 in TABLE IV show that dyes with a meso-chlorine atom are often especially good. However, some dyes with longer alkane chains on the indole group nitrogens are less preferable, and some with substituents on the end aromatic rings are unacceptable for sensitivity loss, even though they could be used to achieve high absorbance for mottle reduction. The usefulness of a given dye at high absorbance in the imaging layer can be determined by routinely testing each dye for sensitivity loss.

TABLE IV

| Sample | Dye | Absorbance | Sensitivity Loss | Comments |
|---|---|---|---|---|
| 3-11 | AD-14 | 1.11 | 0.12 | Invention |
| 3-12 | AD-15 | 1.07 | 0.13 | Invention |
| 3-13 | AD-16 | 1.01 | 0.15 | Invention |
| 3-14 | AD-17 | 0.98 | 0.15 | Invention |
| 3-15 | AD-18 | 1.11 | 0.16 | Invention |
| 3-16 | AD-19 | 0.84 | 0.23 | Invention |
| 3-17 | AD-20 | 1.07 | 0.24 | Invention |
| 3-18 | AD-21 | 1.11 | 0.26 | Invention |
| 3-19 | AD-22 | 1.08 | 0.30 | Invention |
| 3-20 | AD-23 | 0.93 | 0.05 | Invention |
| 3-21 | AD-24 | 0.73 | 0.07 | Invention |
| 3-22 | AD-25 | 0.99 | 0.08 | Invention |
| 3-23 | AD-26 | 0.97 | 0.08 | Invention |
| 3-24 | AD-27 | 0.69 | 0.08 | Invention |
| 3-25 | AD-28 | 1.07 | 0.11 | Invention |

TABLE IV-continued

| Sample | Dye | Absorbance | Sensitivity Loss | Comments |
|---|---|---|---|---|
| 3-26 | AD-29 | 1.11 | 0.11 | Invention |
| 3-27 | AD-30 | 1.09 | 0.13 | Invention |
| 3-28 | AD-31 | 1.10 | 0.13 | Invention |
| 3-29 | AD-32 | 1.05 | 0.18 | Invention |
| 3-30 | AD-33 | 1.00 | 0.19 | Invention |
| 3-31 | AD-34 | 1.04 | 0.25 | Invention |
| 3-32 | CD-2 | 0.65 | 0.41 | Comparative |
| 3-33 | CD-3 | 1.00 | 0.41 | Comparative |
| 3-34 | CD-4 | 0.65 | 0.50 | Comparative |

Examples 3-35 to 3-43 in TABLE V show that benzindolenine dyes having a six-carbon center ring can have an acceptable sensitivity loss for use at high absorbance in the imaging layer to significantly reduce mottle. However, they are not as preferable as many of the earlier examples, and some are unacceptable.

Examples 3-44 to 3-48 in TABLE V show that benzothiazole dyes can also have an acceptable sensitivity loss for use at high absorbance in the imaging layer for significantly reducing mottle.

Examples 3-49 to 3-50 in TABLE V 4 show that some radiation absorbing compounds which provide acceptable absorbance for reducing mottle result in an unacceptable sensitivity loss. The usefulness of the radiation absorbing compounds at high absorbance in the imaging layer can be determined by routinely testing each one for sensitivity loss.

Example 3-51 in TABLE V shows that squaraine dyes can also have an acceptable sensitivity loss for use at high absorbance in the imaging layer for significantly reducing mottle.

TABLE V

| Sample | Dye | Absorbance | Sensitivity Loss | Comments |
|---|---|---|---|---|
| 3-35 | AD-36 | 1.11 | 0.27 | Invention |
| 3-36 | AD-37 | 1.00 | 0.26 | Invention |
| 3-37 | AD-37 | 1.15 | 0.28 | Invention |
| 3-38 | AD-38 | 1.12 | 0.32 | Invention |
| 3-39 | AD-39 | 0.73 | 0.40 | Invention |
| 3-40 | CD-5 | 1.42 | 0.47 | Comparative |
| 3-41 | CD-6 | 0.98 | 0.48 | Comparative |
| 3-42 | CD-7 | 0.94 | 0.49 | Comparative |
| 3-43 | CD-8 | 0.63 | 0.70 | Comparative |
| 3-44 | AD-40 | 1.09 | 0.10 | Invention |
| 3-45 | AD-41 | 1.08 | 0.20 | Invention |
| 3-46 | AD-42 | 0.98 | 0.22 | Invention |
| 3-47 | AD-43 | 1.07 | 0.28 | Invention |
| 3-48 | AD-44 | 1.03 | 0.30 | Invention |
| 3-49 | CD-9 | 1.05 | 0.45 | Comparative |
| 3-50 | CD-10 | 1.17 | 0.54 | Comparative |
| 3-51 | AD-45 | 0.99 | 0.13 | Invention |

Example 4

Photothermographic materials were prepared as described in Example 1 except that a mixture of radiation absorbing compounds CD-1 and AD-2 was incorporated into the imaging layer at a weight ratio of 4:7 to obtain an absorbance of 0.94. Again, as in Example 1, the two radiation absorbing compounds were added to the topcoat formulation and allowed to diffuse into the imaging layer during coating. A control photothermographic material was also prepared without radiation absorbing compounds. The sensitivity loss was calculated to determine the usefulness of the dye blend for reducing mottle. The material was rated as to sensitivity loss as described above.

The results, shown below in TABLE VI, demonstrate that blending a dye within the scope of this invention (AD-2) with a dye outside the scope of this invention (CD-1), can produce a photothermographic material that has high absorbance for significantly reducing mottle and still provides an acceptable sensitivity loss. The usefulness of any dye blends at high absorbance in the imaging layer can be readily determined by routinely testing a given mixture of two or more radiation sensitive compounds to determine sensitivity loss.

TABLE VI

| Sample | Dye | Absorbance | Sensitivity Loss | Comments |
|---|---|---|---|---|
| 4-1 | CD-1 + AD-2 | 0.94 | 0.32 | Invention |

Example 5

As noted above, the addition of radiation absorbing compounds in addition to reducing mottle may cause a loss of contrast. This can be overcome by addition of a high contrast agent.

Photothermographic materials were prepared as described in Example lexcept that at the completion of preparation of the imaging layer formulation, a solution was added containing 4.5 parts of methanol and 0.02 parts of contrast enhancing agent HC-1. During coating, radiation absorbing compound AD-1 diffused into the imaging layer from the topcoat formulation to obtain the absorbance shown in TABLE VII below. A Control photothermographic material was made without AD-1.

The results, shown in below in TABLE VII, when compared with those of Samples 2-4 and 2-5 above, demonstrate that the effect of radiation absorbing compounds on sensitivity is not constant and may be a function of concentration. For this reason, when comparing radiation absorbing compounds, sensitivity loss should be determined at an absorbance between about 0.6 and 1.2. However, radiation absorbing compounds found to be useful at an absorbance of between about 0.6 and 1.2 may be used to provide a absorbance of 2.0 or more especially by the addition of contrast-enhancing materials to maintain desired contrast.

TABLE VII

| Sample | Dye | Absorbance | Contrast | Sensitivity Loss | Comments |
|---|---|---|---|---|---|
| Control | None | — | 23 | — | — |
| 5-1 | AD-1 | 2.17 | 2.5 | 0.22 | Invention |

Example 6

Photothermographic materials were prepared as described in Example 1 except that to 65 parts of the final imaging formulation, a solution was added containing 4.3 parts of MEK and 0.043 parts of radiation absorbing compound AD-1. Thus, the resulting photothermographic material with a high absorbance was prepared with a radiation absorbing compound incorporated directly into the imaging layer formulation, and coated simultaneously with a topcoat containing no radiation absorbing compound. This material was compared to an identically prepared, coated, and imaged control photothermographic material but without AD-1.

The results, shown below in TABLE VIII, demonstrate that there is no significant difference between incorporating the radiation absorbing compound directly into the imaging layer or by diffusing it into the imaging layer from the topcoat formulation. Any method of incorporating the compounds into the imaging layer(s) is can be used and is considered to be within the scope of this invention.

TABLE VIII

| Sample | Dye | Absorbance | Sensitivity Loss | Comments |
|---|---|---|---|---|
| 6-1 | AD-1 | 1.31 | 0.27 | Invention |

Example 7

Photothermographic materials were prepared in a similar fashion to that described in Example 1 except that slide coating was used as the coating method and the web (support and applied layers) were conveyed at a rate of 25 meters per minute during both coating and drying. Mottle was effectively reduced at an absorbance greater than 0.6 and especially at an absorbance greater than 1.0.

Example 8

Photothermographic materials were prepared in a similar fashion to that described in Example 1 except that slide coating was used as the coating method and the web (support and applied layers) were conveyed at a rate of 100 meters per minute during both coating and drying. Mottle was effectively reduced especially at an absorbance greater than 1.0.

The invention has been described in detail with particular reference to certain preferred embodiments thereof, but it will be understood that variations and modifications can be effected within the spirit and scope of the invention.

We claim:

1. A photothermographic material that comprises a support having thereon one or more thermally-developable imaging layers comprising a binder and in reactive association, a photosensitive silver halide, a non-photosensitive source of reducible silver ions, and a reducing composition for said non-photosensitive source of reducible silver ions, wherein said one or more thermally-developable imaging layers further comprise one or more radiation absorbing substances that provide a total absorbance in said one or more thermally-developable imaging layers of greater than 0.6 and up to and including 3 at an exposure wavelength, said one or more radiation absorbing substances being chosen such that when they are incorporated into said one or more thermally-developable imaging layers to provide a total absorbance of from about 0.6 to about 1.2, the sensitivity loss is less than 0.4 per absorbance unit, wherein said sensitivity loss is the increase in the log of the exposure (in ergs/cm$^2$) required to produce an image density of $1+D_{min}$.

2. The photothermographic material of claim 1 further comprising a surface protective layer on the same side of said support as said one or more thermally-developable layers, an antihalation layer on the opposite side of said support, or both a surface protective layer and an antihalation layer on their respective sides of said support.

3. The photothermographic material of claim 1 wherein said non-photosensitive source of reducible silver ions is a silver fatty acid carboxylate having 10 to 30 carbon atoms in the fatty acid or a mixture of said silver carboxylates, at least one of which is silver behenate.

4. The photothermographic material of claim 1 wherein said reducing composition comprises at least one hindered phenol.

5. The photothermographic material of claim 4 further comprising a high contrast co-developing agent.

6. The photothermographic material of claim 1 wherein said binder is a hydrophobic binder.

7. The photothermographic material of claim 1 wherein said one or more thermally-developable imaging layers further comprise one or more radiation absorbing substances that provide a total absorbance in said one or more thermally-developable imaging layers of from about 1 to about 2 at an exposure wavelength.

8. The photothermographic material of claim 1 wherein said one or more radiation absorbing compounds are present in an amount of at least $10^{-6}$ mol/m$^2$.

9. The photothermographic material of claim 8 wherein said one or more radiation absorbing compounds are present in an amount of from about $10^{-5}$ to about $10^{-3}$ mol/m$^2$.

10. The photothermographic material of claim 1 wherein said one or more radiation absorbing compounds are represented by the following Structure I.

(I)

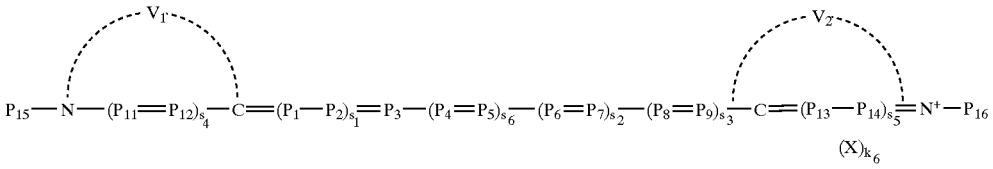

wherein $V_1$ and $V_2$ independently represent the non-metallic atoms necessary to form substituted or unsubstituted 5-, 6-, or 7-membered heterocyclic rings, $P_{15}$ and $P_{16}$ independently represent alkyl, aryl, alkaryl, or heterocyclyl groups, $P_1$, $P_2$, $P_3$, $P_4$, $P_5$, $P_6$, $P_7$, $P_8$, $P_9$, $P_{11}$, $P_{12}$, $P_{13}$, and $P_{14}$ independently represent methine groups or substituted methine groups that may optionally form a ring with one or more other methine groups or with an auxochrome, $s_1$, $s_2$, $s_3$, $s_4$, $s_5$, and $s_6$ are independently equal to 0 or 1, X is an electric charge neutralizing counterion, and $k_1$ is an integer inclusive of 0 necessary to neutralize an electric charge in the molecule.

11. The photothermographic material of claim 1 wherein said one or more radiation absorbing compounds are represented by the following Structure II.

(II)

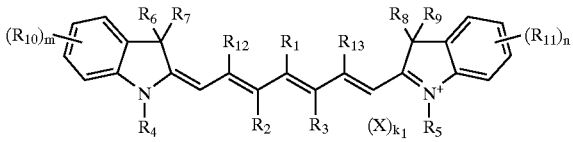

wherein $R_1$ represents hydrogen, halogen, alkyl, heterocyclyl, alkythio, arylthio, alkoxy, aryloxy, and amino groups, $R_2$, $R_3$, $R_{12}$, and $R_{13}$ independently represent hydrogen or $R_{12}$ and $R_1$, $R_2$ and $R_3$, or $R_1$ and $R_{13}$ taken together represent the atoms necessary to form a 5- or 6-membered carbocyclic or heterocyclic ring, or $R_{12}$, $R_1$ and $R_{13}$ may be joined to form fused rings that are also preferably 5- or 6-membered carbocyclic or heterocyclic rings, $R_4$ and $R_5$ independently represent alkyl, aryl, alkaryl, or heterocyclyl groups, $R_6$, $R_7$, $R_8$, and $R_9$ independently represent alkyl groups or aryl groups, or $R_6$ and $R_7$, and $R_8$ and $R_9$ can form a 5- or 6-membered carbocyclic or heterocyclic ring, $R_{10}$ and $R_{11}$ independently represent a substituted or unsubstituted alkyl, aryl, alkoxy, aryloxy, alkyl(or aryl)—$SO_2$—, fused carbocyclic, heterocyclic, or aromatic rings, halo, secondary or tertiary amino, heterocyclyl, alkyl(or aryl)—CO—, alkyl(or aryl)—COO, R"R'"NCO—, nitro, cyano, or R"R'"$NSO_2$— groups, R" and R'" are independently substituted or unsubstituted alkyl or aryl groups, m and n are each independently an integer from 0 to 4, X is an electric charge neutralizing counterion, and $k_1$ is an integer inclusive of 0 necessary to neutralize an electric charge in the molecule.

12. The photothermographic material of claim 1 wherein said one or more radiation absorbing compounds are represented by the following Structure III.

(III)

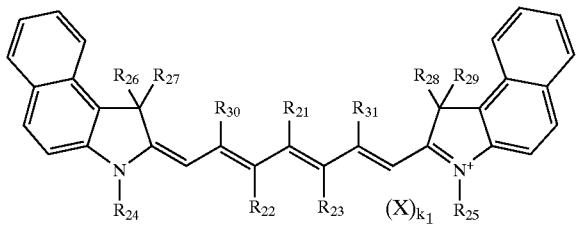

wherein $R_{21}$ represents hydrogen, halogen, alkyl, heterocyclyl, alkythio, arylthio, alkoxy, aryloxy, and amino groups, $R_{22}$, $R_{23}$, $R_{30}$, and $R_{31}$ independently represent hydrogen or $R_{30}$ and $R_{21}$, $R_{22}$ and $R_{23}$, or $R_{21}$ and $R_{31}$ taken together represent the atoms necessary to form a 5- or 6-membered carbocyclic or heterocyclic ring, or $R_{30}$, $R_{21}$ and $R_{31}$ may be joined to form fused rings that are also preferably 5- or 6-membered carbocyclic or heterocyclic rings, $R_{24}$ and $R_{25}$ independently represent alkyl, aryl, alkaryl, or heterocyclyl groups, $R_{26}$, $R_{27}$, $R_{28}$, and $R_{29}$ independently represent alkyl groups or aryl groups, or $R_{26}$ and $R_{27}$, and $R_{28}$ and $R_{29}$ can form a 5- or 6-membered carbocyclic or heterocyclic ring, X is an electric charge neutralizing counterion, and $k_1$ is an integer inclusive of 0 necessary to neutralize an electric charge in the molecule.

13. The photothermographic material of claim 1 wherein said one or more radiation absorbing compounds are represented by the following Structure IV.

(IV)

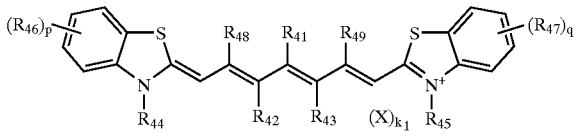

wherein $R_{41}$ represents hydrogen, alkyl, heterocyclyl, alkythio, arylthio, alkoxy, aryloxy, halo, and amino groups, $R_{42}$, $R_{43}$, $R_{48}$, and $R_{49}$, independently represent hydrogen, or $R_{48}$ and $R_{41}$, or $R_{42}$ and $R_{43}$, or $R_{41}$, and $R_{49}$, taken together represent the atoms necessary to form a 5- or 6-membered carbocyclic or heterocyclic ring, or $R_{48}$, $R_{41}$ and $R_{49}$ may be joined to form fused rings that are also preferably 5- or 6-membered carbocyclic or heterocyclic rings, $R_{44}$ and $R_{45}$ independently represent alkyl, aryl, alkaryl, or heterocyclyl groups, $R_{46}$ and $R_{47}$ independently represent a substituted or unsubstituted alkyl, aryl, alkoxy, aryloxy, alkyl(or aryl)—$SO_2$—, fused carbocyclic, heterocyclic, or aromatic rings, halo, secondary or tertiary amino, heterocyclyl, alkyl(or aryl)—CO—, alkyl(or aryl)—COO, R"R'"NCO—, nitro, cyano, or R"R'"$NSO_2$— groups, R" and R'" are independently substituted or unsubstituted alkyl or aryl groups, p and q are each independently an integer from 0 to 4, X is an electric charge neutralizing counterion, and $k_1$ is an integer inclusive of 0 necessary to neutralize an electric charge in the molecule.

14. The photothermographic material of claim 1 wherein said one or more radiation absorbing compounds is a cyanine, hemicyanine, merocyanine, squaraine, or oxonol dye.

15. The photothermographic material of claim 1 wherein said one or more radiation absorbing compounds are one or more of the following Compounds AD-1 to AD-45, or mixtures thereof:

AD-1

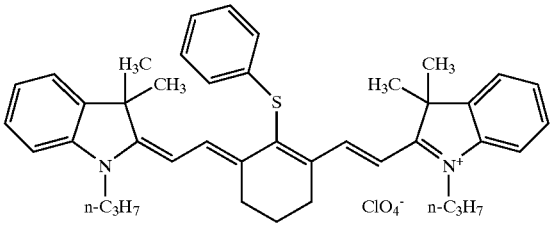

AD-2

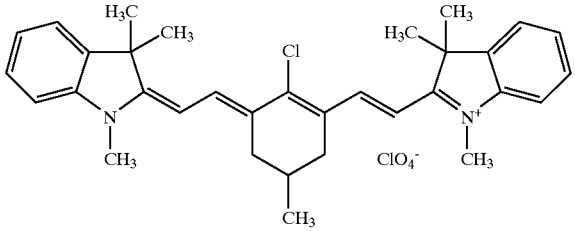

AD-3

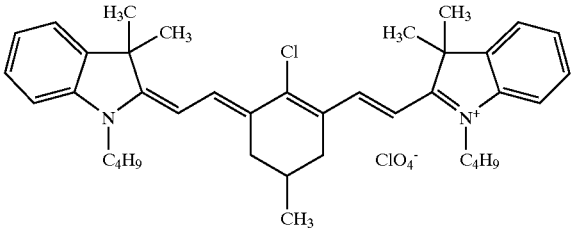

AD-4

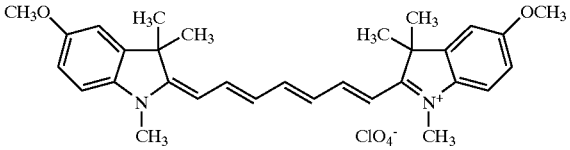

AD-5

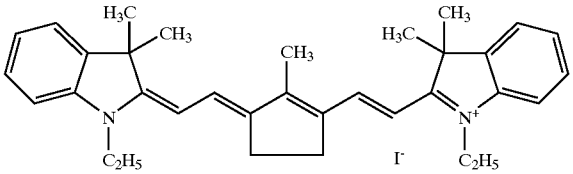

AD-6

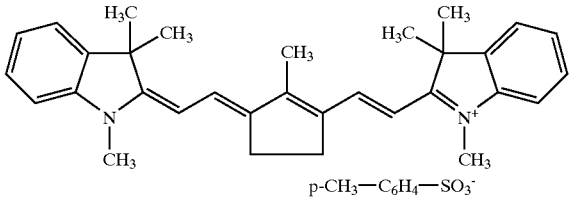

AD-7

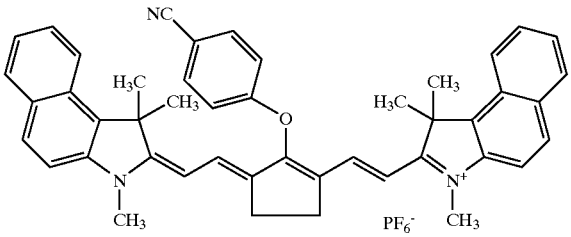

AD-8

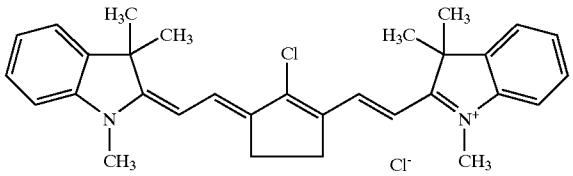

-continued
AD-9
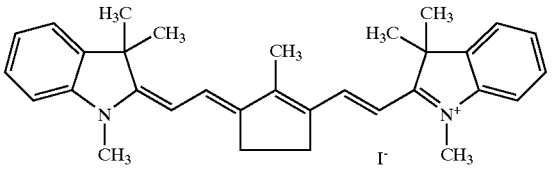
AD-10
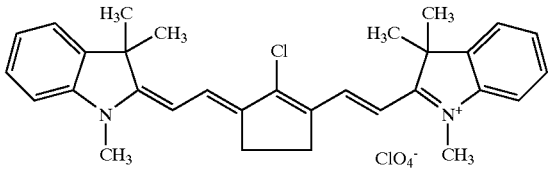
AD-11
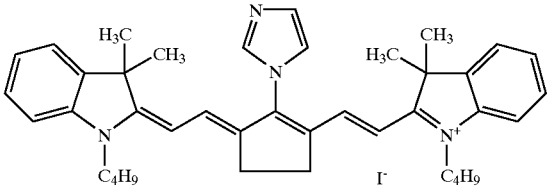
AD-12
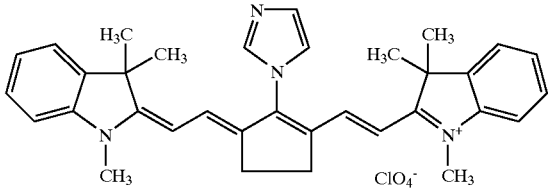
AD-13
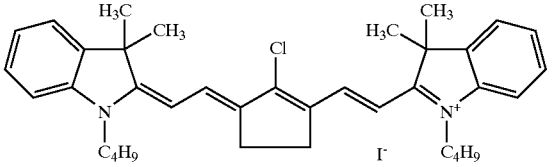
AD-14
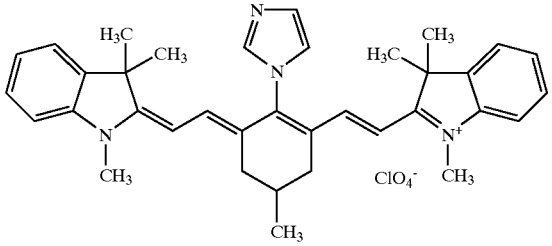
AD-15
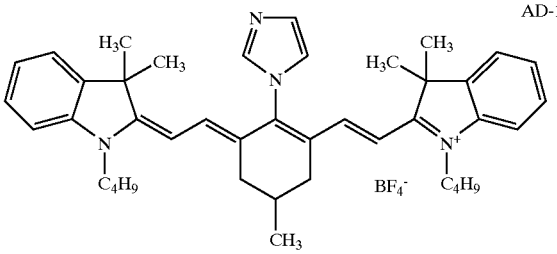
AD-16
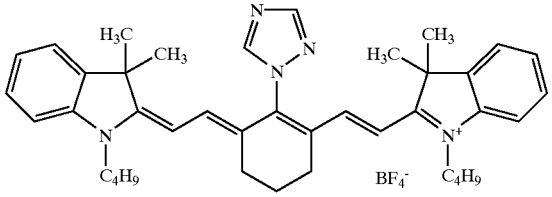
AD-17
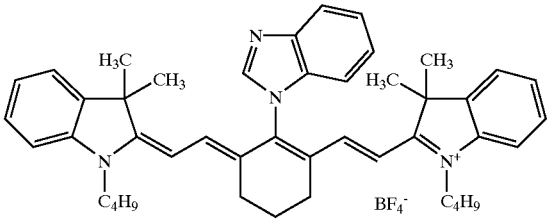
AD-18
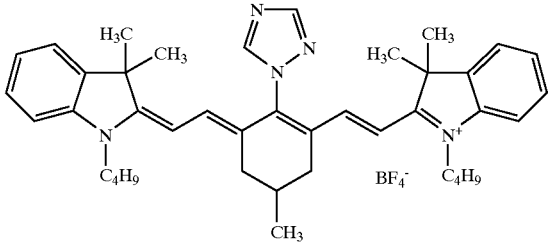
AD-19
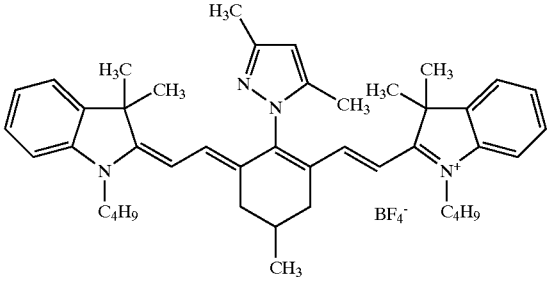
AD-20
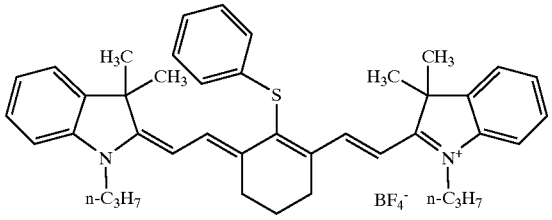

-continued
AD-21
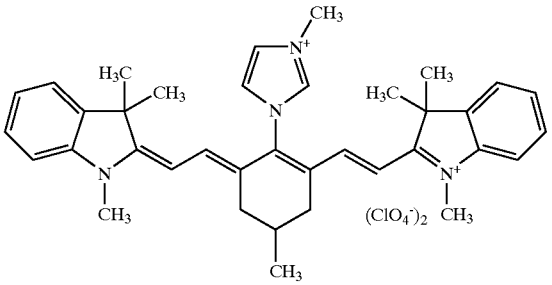
AD-22
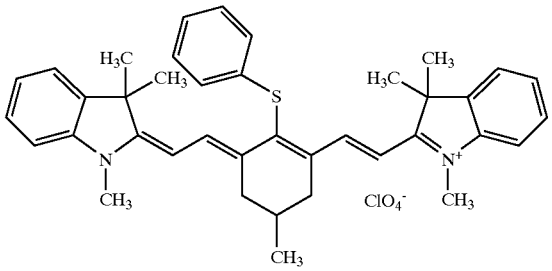
AD-23
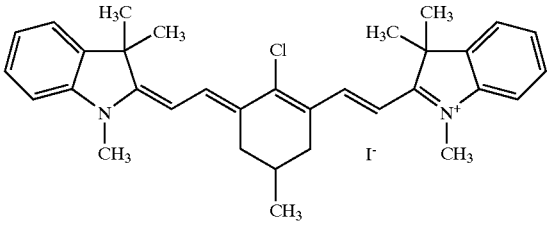
AD-24
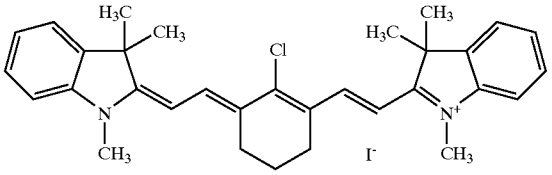
AD-25
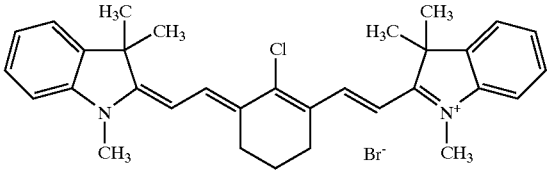
AD-26
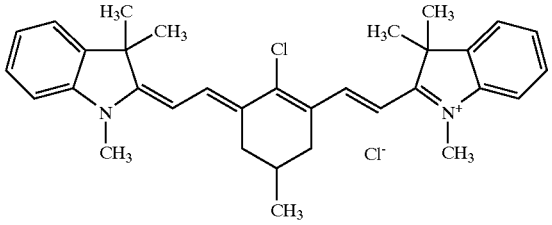
AD-27
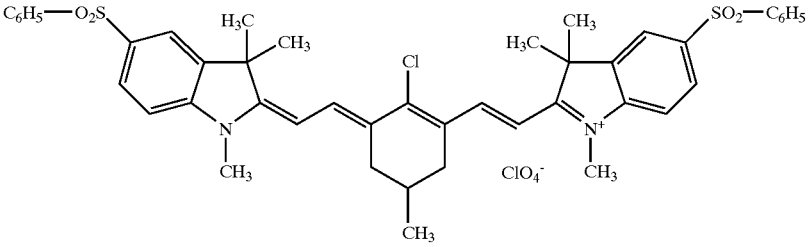
AD-28
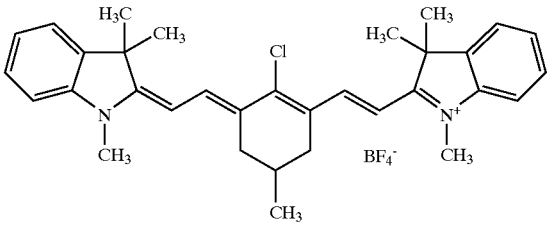
AD-29
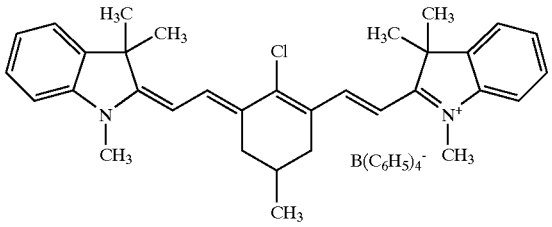

-continued
AD-30
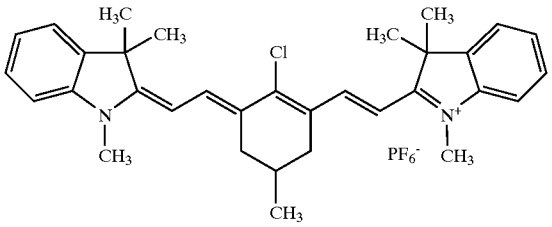
AD-31
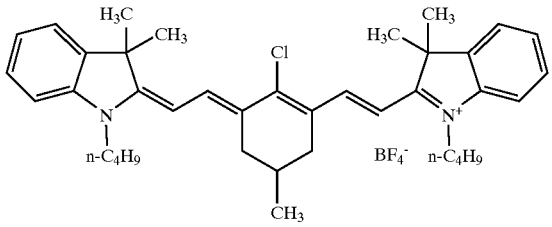
AD-32
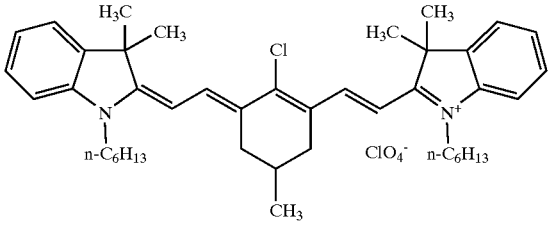
AD-33
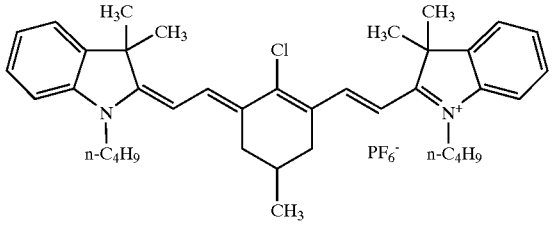
AD-34
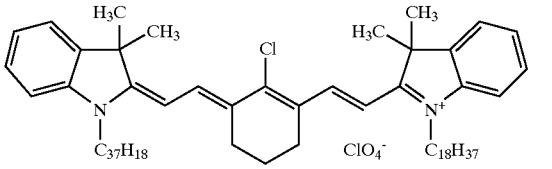
AD-35
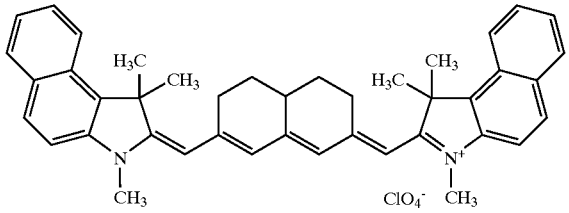
AD-36
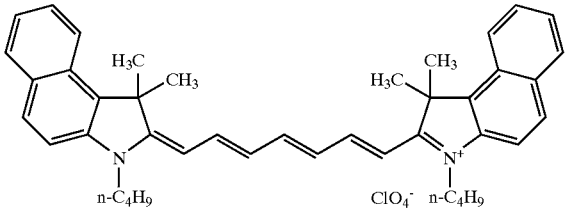
AD-37
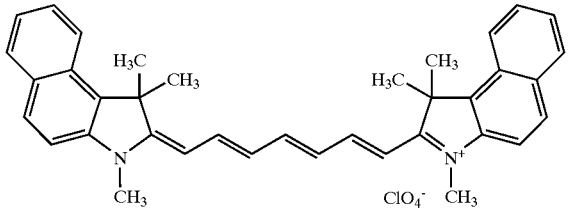
AD-38
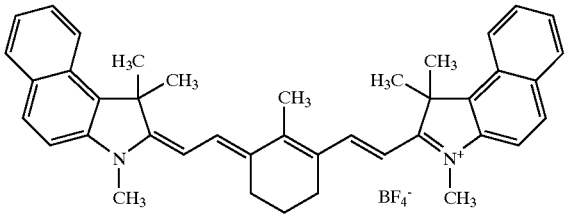
AD-39
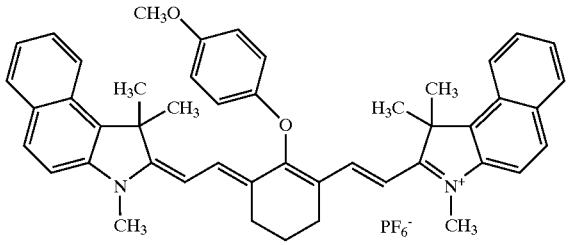
AD-40
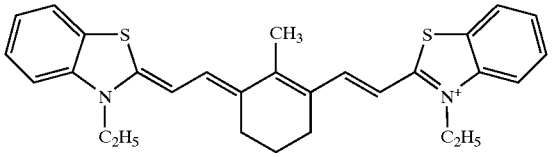
AD-41
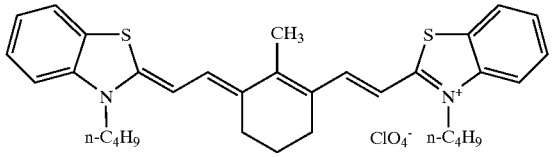

-continued

AD-42

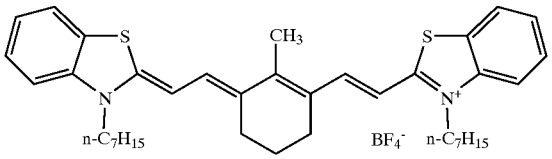

AD-43

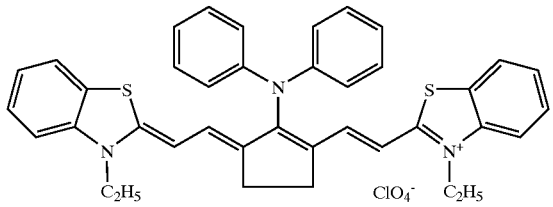

AD-44

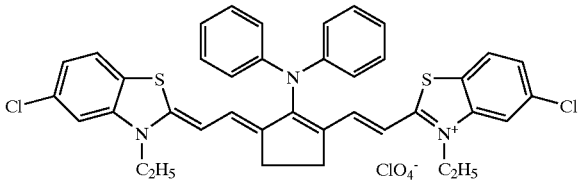

AD-45

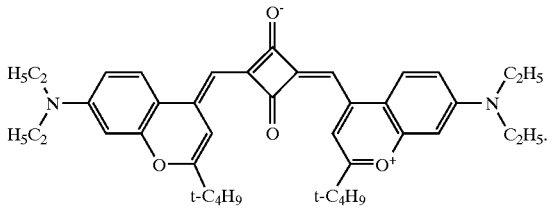

16. The photothermographic material of claim 1 further comprising at least one spectral sensitizing dye.

17. The photothermographic material of claim 16 comprising a merocyanine or cyanine spectral sensitizing dye in an amount of at least $10^{-10}$ mol/mol of silver halide.

18. The photothermographic material of claim 1 further comprising a toner and a polyhalo antifoggant having a $—SO_2C(X')_3$ group wherein X' represents the same or different halogen atoms.

19. A black-and-white photothermographic material comprising a support having on one side thereof:

a) a thermally-developable imaging layer comprising a hydrophobic binder and in reactive association, a photosensitive silver bromide or silver bromoiodide, or mixtures thereof, one or more non-photosensitive silver carboxylates, at least one of which is silver behenate, and a merocyanine or cyanine spectral sensitizing dye, b) a protective layer that is farther from said support than said imaging layer, said photothermographic material also comprising an antihalation layer on the backside of said support, said antihalation layer comprising a binder and at least one antihalation dye, wherein said thermally-developable imaging layer further comprises one or more radiation absorbing substances that provide a total absorbance in said one or more thermally-developable imaging layers greater than 0.6 and up to and including 3 at an exposure wavelength, said one or more radiation absorbing substances chosen such that when they are incorporated into said thermally-developable layer to provide a total absorbance of from about 0.6 to about 1.2, the sensitivity loss is less than 0.4 per absorbance unit, wherein said sensitivity loss is the increase in the log of the exposure (in ergs/cm$^2$) required to produce an image density of $1+D_{min}$, and said one or more radiation absorbing substances are cyanine, hemicyanine, merocyanine, squaraine, or oxonol dyes, or mixtures thereof.

20. The photothermographic material of claim 19 wherein said antihalation layer comprises cyclobutenediylium, 1,3-bis[2,3-dihydro-2,2-bis[[1-oxohexyl)oxy]methyl]-1H-perimidin-6-yl]-2,4-dihydroxy-, bis(inner salt), or 3H-Indolium, 2-[2-[2-chloro-3-[(1,3-dihydro-1,3,3-trimethyl-2H-indol-2-ylidene)ethylidene]-5-methyl-1-cyclohexen-1-yl]ethenyl]-1,3,3-trimethyl-, perchlorate as an antihalation dye.

21. The photothermographic material of claim 19 wherein said one or more radiation absorbing compounds are represented by the following Structure I.

(I)

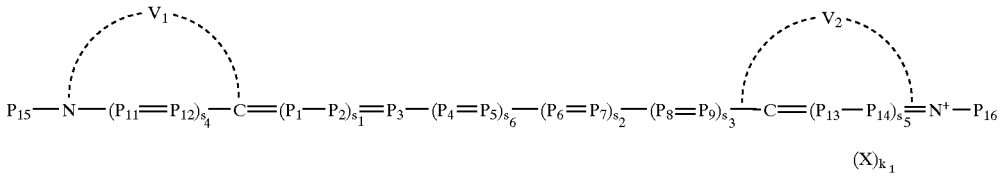

wherein $V_1$ and $V_2$ independently represent the non-metallic atoms necessary to form substituted or unsubstituted 5-, 6-, or 7-membered heterocyclic rings, $P_{15}$ and $P_{16}$ independently represent alkyl, aryl, alkaryl, or heterocyclyl groups, $P_1$, $P_2$, $P_3$, $P_4$, $P_5$, $P_6$, $P_7$, $P_8$, $P_9$, $P_{11}$, $P_{12}$, $P_{13}$, and $P_{14}$ independently represent methine groups or substituted methine groups that may optionally form a ring with one or more other methine groups or with an auxochrome, $s_1$, $s_2$, $s_3$, $s_4$, $s_5$, and $s_6$ are independently equal to 0 or 1, X is an electric charge neutralizing counterion, and $k_1$ is an integer inclusive of 0 necessary to neutralize an electric charge in the molecule.

22. The photothermographic material of claim 19 wherein said one or more radiation absorbing compounds are one or more of the following Compounds AD-1 to AD45, or mixtures thereof:

AD-1
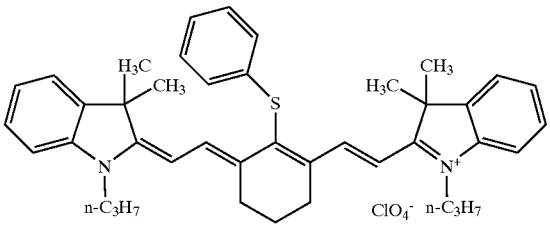
AD-2
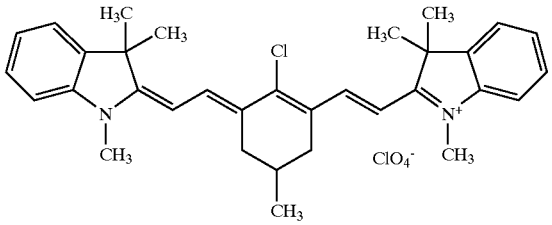
AD-3
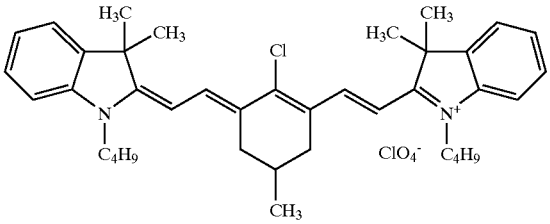
AD-4
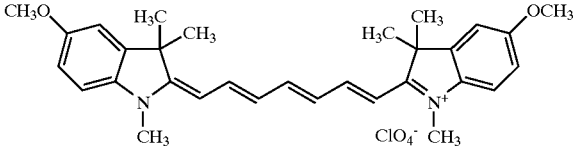
AD-5
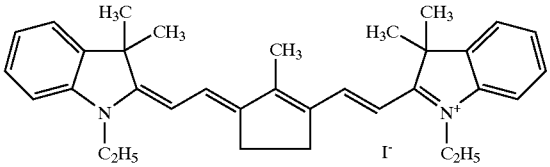
AD-6
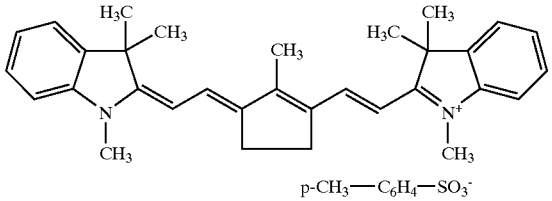
AD-7
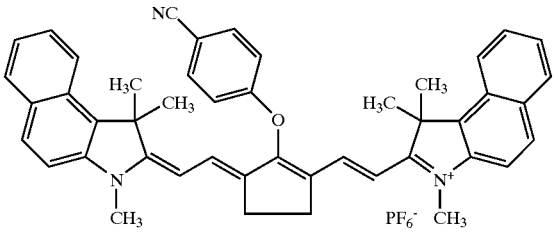
AD-8
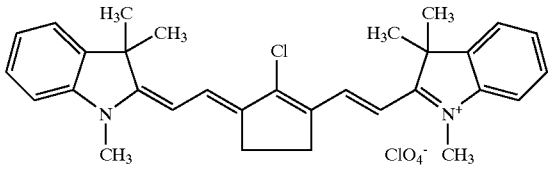
AD-9
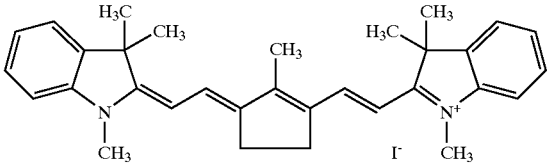
AD-10
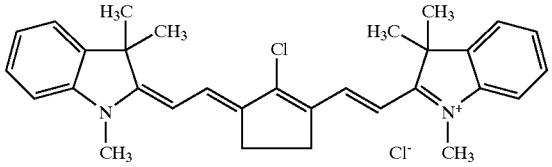
AD-11
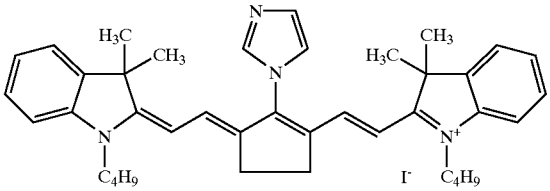
AD-12
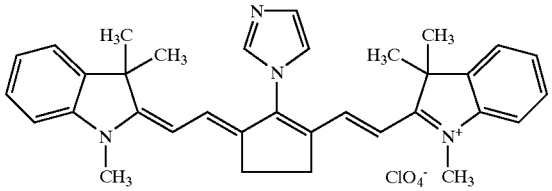

-continued
AD-13
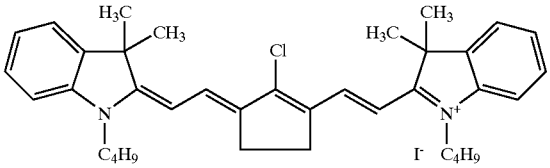
AD-14
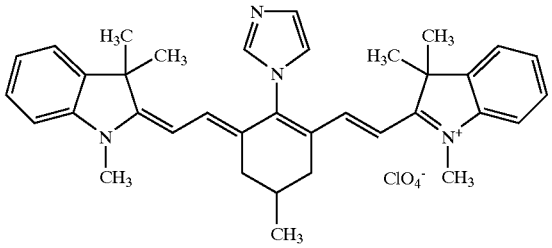
AD-15
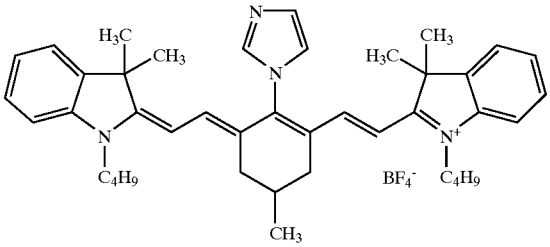
AD-16
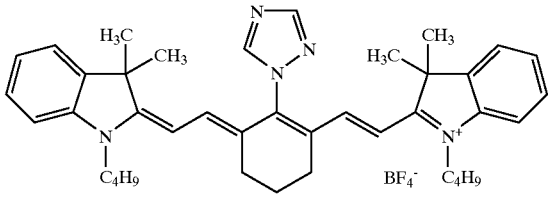
AD-17
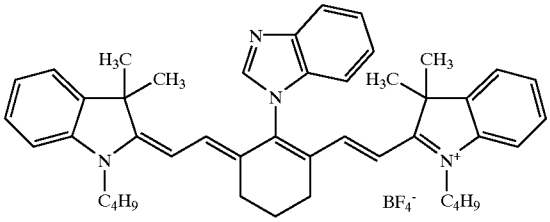
AD-18
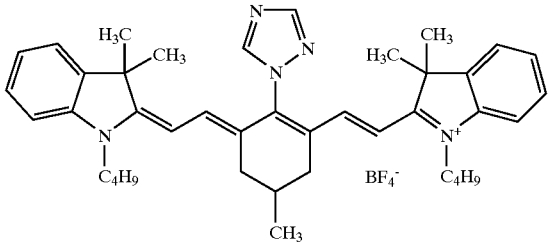
AD-19
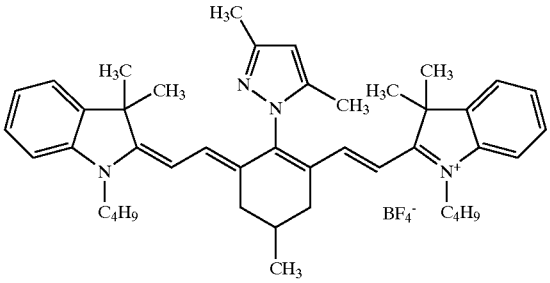
AD-20
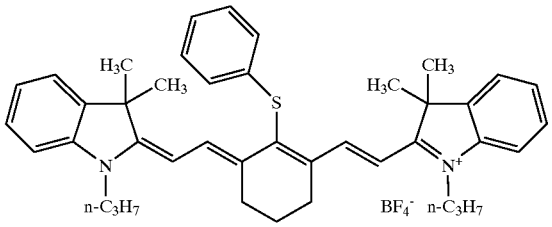
AD-21
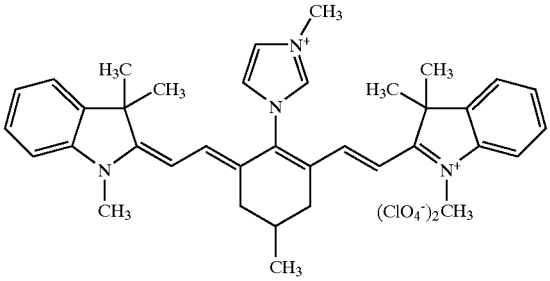
AD-22
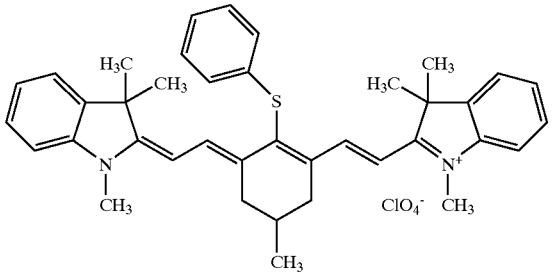

-continued
AD-23
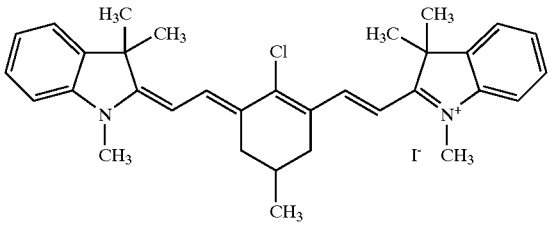
AD-24
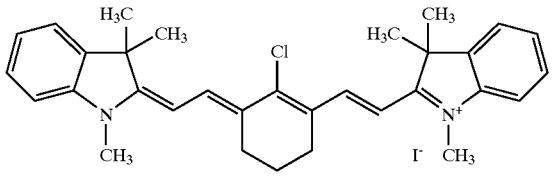
AD-25
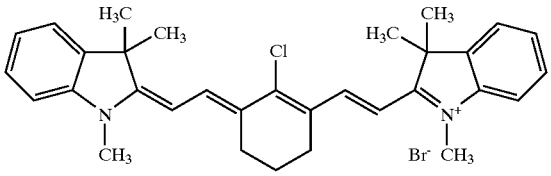
AD-26
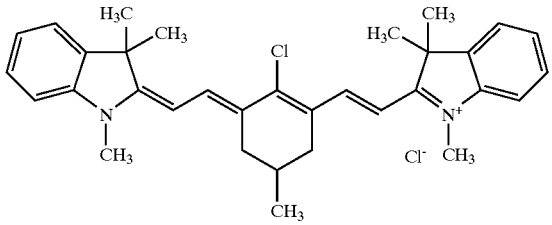
AD-27
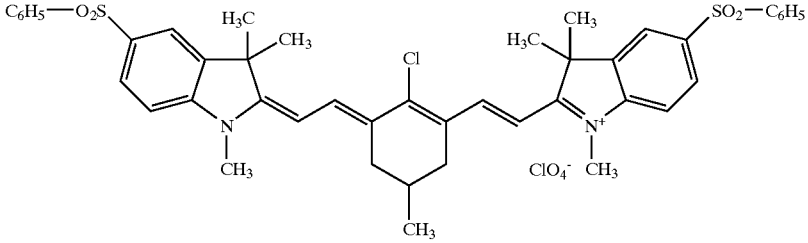
AD-28
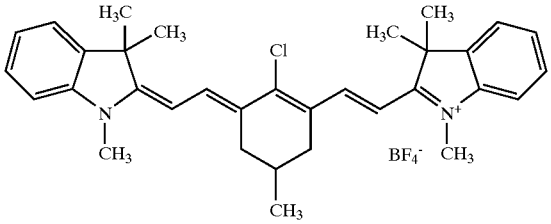
AD-29
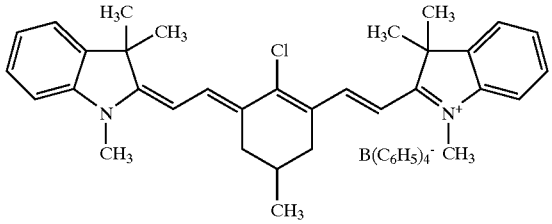
AD-30
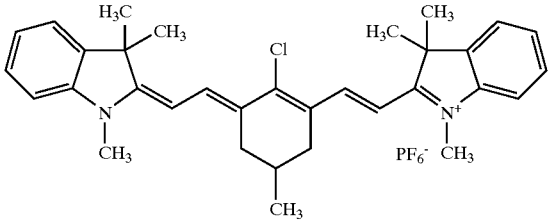
AD-31
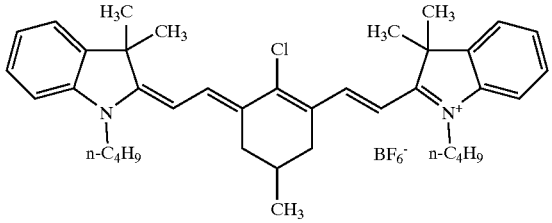
AD-32
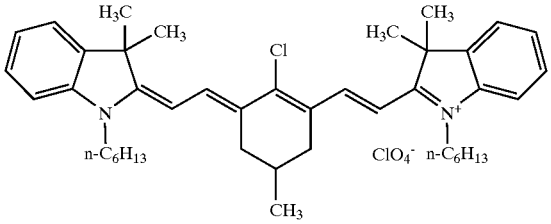
AD-33
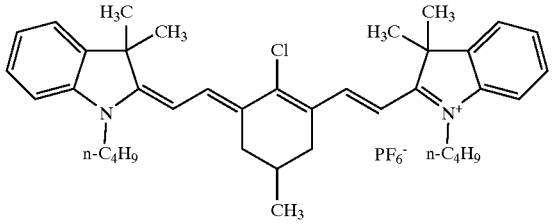

-continued

AD-34

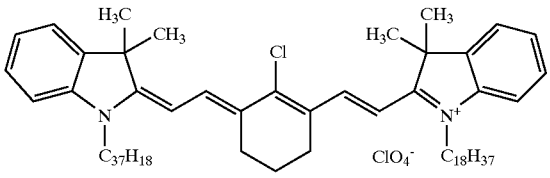

AD-35

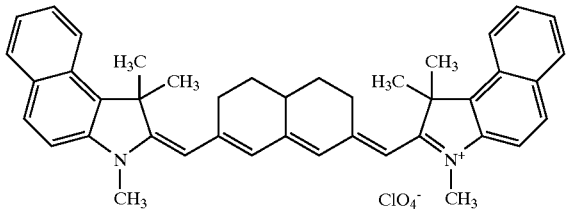

AD-36

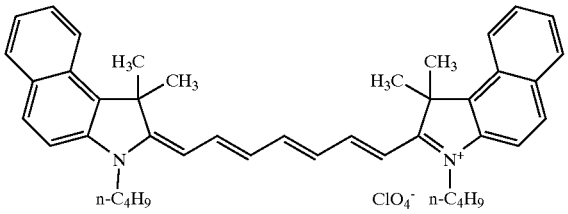

AD-37

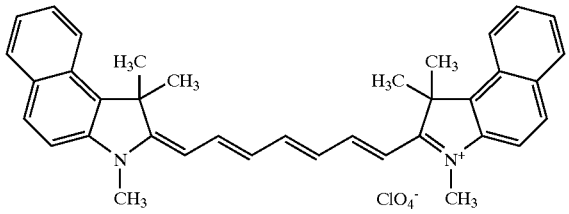

AD-38

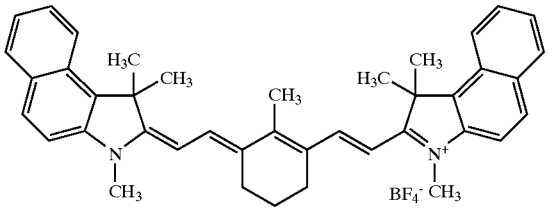

AD-39

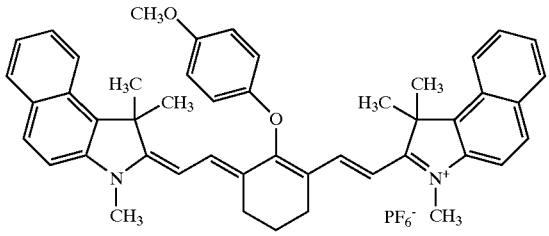

AD-40

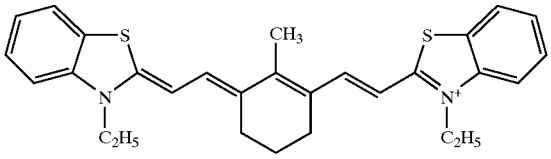

AD-41

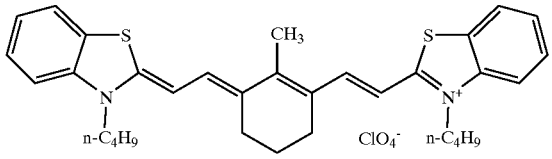

AD-42

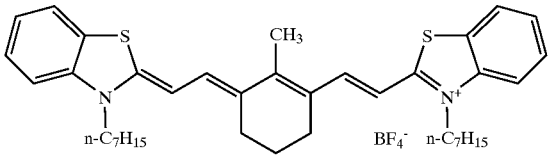

AD-43

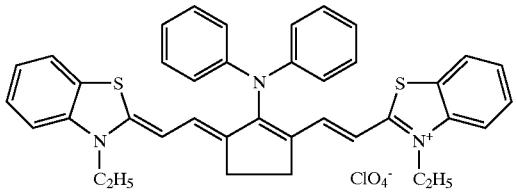

AD-44

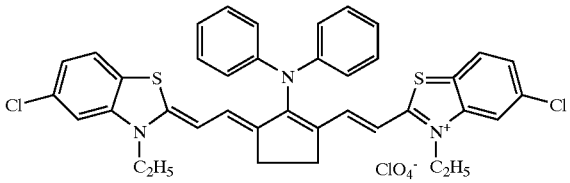

AD-45

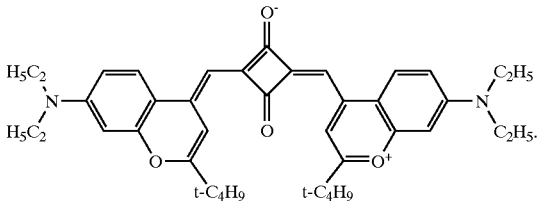

23. A method of forming a visible image comprising:

A) imagewise exposing the black-and-white photothermographic material of claim 1 to electromagnetic radiation at a wavelength greater than 700 nm to form a latent image, and B) simultaneously or sequentially, heating said exposed photothermographic material to develop said latent image into a visible image.

24. The method of claim 23 wherein said photothermographic support is transparent and said method further comprises:

C) positioning said exposed and heat-developed photothermographic material between a source of imaging radiation and an imageable material that is sensitive to said imaging radiation, and D) exposing said imageable material to said imaging radiation through the visible image in said exposed and heat-developed photothermographic material to provide an image in said imageable material.

25. The method of claim 23 wherein said imagewise exposing is carried out using a laser at a wavelength of from about 750 to about 850 nm.

26. A photothermographic material that is sensitive to radiation at a wavelength of at least 700 nm and that comprises a support having thereon one or more thermally-developable imaging layers comprising a binder and in reactive association, a photosensitive silver halide, a non-photosensitive source of reducible silver ions, and a reducing composition for said non-photosensitive source of reducible silver ions, wherein said one or more thermally-developable imaging layers further comprise one or more radiation absorbing substances that provide a total absorbance in said one or more thermally-developable imaging layers of greater than 0.6 and up to and including 3 at an exposure wavelength, said one or more radiation absorbing substances being chosen such that when they are incorporated into said one or more thermally-developable imaging layers to provide a total absorbance of from about 0.6 to about 1.2, the sensitivity loss is less than 0.4 per absorbance unit, wherein said sensitivity loss is the increase in the log of the exposure (in ergs/cm$^2$) required to produce an image density of $1+D_{min}$ in the visible region of the spectrum.

* * * * *